US005454883A

United States Patent [19]

Yoshie et al.

[11] Patent Number: 5,454,883

[45] Date of Patent: Oct. 3, 1995

[54] HIGH TOUGHNESS LOW YIELD RATIO, HIGH FATIGUE STRENGTH STEEL PLATE AND PROCESS OF PRODUCTION SAME

[75] Inventors: Atsuhiko Yoshie; Masaaki Fujioka; Takashi Fujita; Yasumitsu Onoe; Shuji Aihara, all of Futtsu, Japan

[73] Assignee: Nippon Steel Corporation, Tokyo, Japan

[21] Appl. No.: 189,379

[22] Filed: Jan. 31, 1994

[30] Foreign Application Priority Data

| | | | |
|---|---|---|---|
| Feb. 2, 1993 | [JP] | Japan | 5-015755 |
| Feb. 2, 1993 | [JP] | Japan | 5-015756 |
| Oct. 8, 1993 | [JP] | Japan | 5-253484 |
| Oct. 8, 1993 | [JP] | Japan | 5-253485 |

[51] Int. Cl.[6] ..... C21D 8/02; C22C 38/06

[52] U.S. Cl. ..... 148/320; 148/335; 148/336; 148/654; 148/661

[58] Field of Search ..... 148/320, 335, 148/336, 654, 661

[56] References Cited

U.S. PATENT DOCUMENTS

| | | | |
|---|---|---|---|
| 4,917,738 | 4/1990 | Takano et al. | 148/335 |
| 5,328,528 | 7/1994 | Chen | 148/320 |

FOREIGN PATENT DOCUMENTS

| | | | |
|---|---|---|---|
| 54-30386 | 9/1979 | Japan . | |
| 55-41927 | 3/1980 | Japan . | |
| 55-97425 | 7/1980 | Japan . | |
| 57-108241 | 7/1982 | Japan . | |
| 58-6937 | 1/1983 | Japan . | |
| 58-93814 | 6/1983 | Japan . | |
| 59-211528 | 11/1984 | Japan . | |
| 60-5820 | 1/1985 | Japan . | |
| 60-17013 | 1/1985 | Japan . | |
| 60-43425 | 3/1985 | Japan . | |
| 60-165320 | 8/1985 | Japan . | |
| 61-96030 | 5/1986 | Japan | 148/654 |
| 62-174322 | 7/1987 | Japan . | |
| 63-4017 | 1/1988 | Japan . | |
| 63-286517 | 11/1988 | Japan . | |
| 63-293110 | 11/1988 | Japan . | |
| 63-282240 | 11/1988 | Japan . | |
| 64-79345 | 3/1989 | Japan . | |
| 402019424 | 1/1990 | Japan | 148/654 |
| 3-10049 | 1/1991 | Japan . | |
| 3-61748 | 9/1991 | Japan . | |
| 3-291355 | 12/1991 | Japan . | |

OTHER PUBLICATIONS

R. N. Caron, G. Krauss, "The Tempering of Fe–C Lath Martensite", Metallurgical Trans. vol. 3, Sep. 1972, pp. 2381–2385. (pp. 2384–2385 FIGS. 4–8).

*Primary Examiner*—Deborah Yee
*Attorney, Agent, or Firm*—Kenyon & Kenyon

[57] ABSTRACT

A steel plate having a high toughness, low yield ratio and high fatigue strength is provided by preserving the fine metallographical microstructure of martensite or bainite while austenitizing extremely fine portions of the microstructure, and during cooling, dispersing the portions as martensite, retained austenite, cementite or mixture thereof in a tempered martensite or tempered bainite phase.

32 Claims, 5 Drawing Sheets

COMPARATIVE STEELS (△),
(▲: LOW YIELD RATIO WITH VERY POOR TOUGHNESS)
INVENTIVE STEELS (○)
YIELD RATIO (%)
100
90
80
70
60
50
40
TENSILE STRENGTH (Kgf/mm²)
40
60
80
100
120
140
160

COMPARATIVE STEELS (△).
(▲: LOW YIELD RATIO WITH VERY POOR TOUGHNESS)
INVENTIVE STEELS
14
14
FLUCTUATION
100
90
80
70
60
50
40
YIELD RATIO (%)
40
60
80
100
120
140
160
TENSILE STRENGTH (Kgf/mm²)

HIGH TOUGHNESS LOW YIELD RATIO, HIGH FATIGUE STRENGTH STEEL PLATE AND PROCESS OF PRODUCTION SAME

BACKGROUND OF THE INVENTION

1. Field of the Invention

The present invention relates to a high toughness, low yield ratio, high fatigue strength steel plate and a process of producing same.

2. Description of the Related Art

In recent years, demand has been increasing for steel plates having a low yield ratio and high tensile strength ensuring the good earthquake-resistance required for plates, pipes, sections and other steel members used for constructing buildings or other structures.

In response to this demand, processes were proposed in Japanese Unexamined Patent Publication (Kokai) Nos. 55-41927 and 55-97425. The former uses controlled rolling and controlled cooling whereas the latter uses quench-hardening and tempering. Both of these processes provide a steel having a 60 kgf/mm$^2$-grade tensile strength and do not generally produce steels having high strength.

Other manufacturing processes have been also developed, such as those described in Japanese Unexamined Patent Publication (Kokai) Nos. 63-293110 and 59-211528. In these processes, a hot-rolled steel plate is allowed to cool naturally to a selected temperature and is then rapidly cooled so as to establish a metallographical microstructure in which the ferrite phase is mixed with bainite and/or martensite phases to provide a low yield ratio. In these processes, however, the ferrite phase is generated during the natural or air cooling and has a coarse grain size which results in poor toughness. Japanese Unexamined Patent Publication (Kokai) No. 63-286517 disclosed another process in which a hot-rolled steel is heat-treated in a dual-phase temperature region higher than the $A_{C1}$ temperature of the steel. This process effectively lowers the yield ratio, but has a problem that such a high temperature heat treatment induces the hot-rolled microstructure to coarsen by recrystallization and transformation, which results in poor toughness.

Marine vessels, offshore structures, bridges, and land-based structures are often subjected to fluctuating load, so that weld bonds and unavoidable structural stress concentrators generate fatigue cracks which propagate and cause the structure to fracture. Many measures have been taken in designing and construction of these structures in order to avoid stress concentration, as proposed in Japanese Examined Patent Publication (Kokoku) No. 54-30386. However, this imposes significant limitations on the design and construction and/or requires increase in the structure weight. Therefore, it has been desired to improve the fatigue strength of a steel member, and not rely upon design or construction.

To improve the fatigue strength of a steel member, processes were proposed in Japanese Examined Patent Publication (Kokoku) No. 3-61748 and Japanese Unexamined Patent Publication (Kokai) No. 3-291355. The process of the former, however, is only applicable to steels having relatively high carbon contents such as strengthening parts of automobiles, and is not suitable for the above-recited structures. The process of the latter also has a drawback of limited application due to an uneven distribution of properties through the thickness of the steel.

On the other hand, Japanese Unexamined Patent Publication (Kokai) No. 64-79345 disclosed a steel containing retained austenite phase, in which the TRIP phenomenon is utilized. This steel is basically used in the form of a sheet imparted with good combination of strength and ductility, but not imparted with improved fatigue strength. Steel microstructures containing retained austenite were also discussed in Japanese Unexamined Patent Publication (Kokai) Nos. 58-139656, 60-5820, 60-17013, 60-43425, 60-165320, 63-4017, 63-282240 and 3-10049, which all were intended to improve the toughness and workability of hot- or cold-rolled steel sheet and do not provide a steel plate having high fatigue strength, which is an object of the present invention.

Japanese Unexamined Patent Publication (Kokai) No. 57-108241 disclosed a steel having a mixed microstructure containing martensite phase, specifically a ferrite-martensite mixed microstructure, which is basically used in the form of a sheet having good combination of strength and elongation, but not having improved fatigue strength. Similar steels are disclosed in Japanese Unexamined Patent Publication (Kokai) Nos. 57-137542 and 58-6937. Japanese Unexamined Patent Publication (Kokai) Nos. 58-93814 and 62-174322 disclosed steel plates having a composite microstructure containing martensite phase, which are intended to provide a low yield ratio but do not provide improved fatigue strength.

SUMMARY OF THE INVENTION

The object of the present invention is to provide a steel plate having a high toughness, low yield ratio and high fatigue strength, and a process of producing same.

To achieve the object according to the first aspect of the first invention of the present application, there is provided a process of producing a steel plate having a high toughness, low yield ratio and high fatigue strength, the process comprising the steps of:

hot-rolling a steel to form a steel plate, the steel consisting of:

0.02 to 0.5 wt % C, 0.02 to 10.0 wt % Mn, 0.01 to 1.0 wt % Si, 0.1 wt % or less Al, and the balance consisting of Fe and unavoidable impurities;

quench-hardening the steel plate either immediately, or after reheating, after completion of the hot rolling so as to establish a quenched microstructure substantially composed of martensite, bainite or a mixture thereof; and tempering the quench-hardened steel plate by heating at a heating rate of 1° C./sec or more to a temperature of $A_{C1}$ or higher and holding at this temperature for a time of not more than 15 min.

In this process, the tempering is generally carried out at a temperature of not higher than $A_{C3}$.

According to the second aspect of the first invention of the present application, there is provided a process of producing a steel plate having a high toughness, low yield ratio and high fatigue strength, the process comprising the steps of:

hot-rolling a steel to form a steel plate, the steel consisting of:

0.02 to 0.5 wt % C, 0.02 to 10.0 wt % Mn, 0.01 to 1.0 wt % Si, 0.1 wt % or less Al, at least one element selected from the group consisting of:

3.0 wt % or less Mo,
10.0 wt % or less Ni,
3.0 wt % or less Cr,
0.1 wt % or less V,
0.1 wt % or less Nb,
0.1 wt % or less Ti,
0.003 wt % or less B,
10.0 wt % or less Cu,
10.0 wt % or less Co, and
3.0 wt
or less W, and the balance consisting of Fe and unavoidable impurities;

quench-hardening the steel plate either immediately, or after reheating, after completion of the hot rolling so as to establish a quenched microstructure substantially composed of martensite, bainite or a mixture thereof; and tempering the quench-hardened steel plate by heating at a heating rate of 1° C./sec or more to a temperature of $A_{C1}$ or higher and holding at this temperature for a time of not more than 15 min.

In this process, the tempering is generally carried out at a temperature of not higher than $A_{C3}$.

According to the third aspect of the first invention of the present application, there is provided a process of producing a steel plate having a high toughness, low yield ratio and high fatigue strength, the process comprising the steps of:

hot-rolling a steel to form a steel plate, the steel consisting of:

0.02 to 0.5 wt % C, 0.02 to 10.0 wt % Mn, 0.01 to 1.0 wt % Si, 0.1 wt % or less Al, at least one element selected from the group consisting of:
10.0 wt % or less Ni,
10.0 wt % or less Cu, and
10.0 wt % or less Co, and the balance consisting of Fe and unavoidable impurities, with the following formula being satisfied:

$$2Mn+.5Ni+.5\ Cu+.5Co \geqq 4\ wt\ \%;$$

quench-hardening the steel plate either immediately, or after reheating, after completion of the hot rolling so as to establish a quenched microstructure substantially composed of martensite, bainite or a mixture thereof; and tempering the quench-hardened steel plate by heating to a temperature of from $A_{C1}$ to the $A_{C1}$+80° C. and holding at this temperature for a time of not more than 30 min.

In this process, the heating rate to the tempering temperature may be selected to be either less than or not less than 1.0° C./sec and the holding time at the tempering temperature may be selected to be either within 15 min or between 15 and 30 min.

According to the fourth aspect of the first invention of the present application, there is provided a process of producing a steel plate having a high toughness, low yield ratio and high fatigue strength, the process comprising the steps of:

hot-rolling a steel to form a steel plate, the steel consisting of:

0.02 to 0.5 wt % C, 0.02 to 10.0 wt % Mn, 0.01 to 1.0 wt % Si, 0.1 wt % or less Al, at least one element selected from the group consisting of:
10.0 wt % or less Ni,
10.0 wt % or less Cu, and
10.0 wt % or less Co, at least one element selected from the group consisting of:
3.0 wt % or less Cr,
3.0 wt % or less Mo,
0.1 wt % or less V,
0.1 wt % or less Nb,
0.1 wt % or less Ti,
0.003 wt % or less B, and
3.0 wt % or less W, and the balance consisting of Fe and unavoidable impurities, with the following formula being satisfied:

$$2Mn+.5Ni+.5\ Cu+.5Co \geqq 4\ wt\ \%;$$

quench-hardening the steel plate either immediately, or after reheating, after completion of the hot rolling so as to establish a quenched microstructure substantially composed of martensite, bainite or mixture thereof; and tempering the quench-hardened steel plate by heating to a temperature of from $A_{C1}$ to the $A_{C1}$+80° C. and holding at this temperature for a time of not more than 30 min.

In this process, the heating rate to the tempering temperature may be selected to be either less than or not less than 1.0° C./sec and the holding time at the tempering temperature may be selected to be either within 15 min or between 15 and 30 min.

According to the fifth aspect of the first invention of the present application, there is provided a process of producing a steel plate having a high toughness, low yield ratio and high fatigue strength, the process comprising the steps of:

hot-rolling a steel to form a steel plate, the steel consisting of:

0.02 to 0.5 wt % C, 0.02 to 10.0 wt % Mn, 0.01 to 1.0 wt % Si, 0.1 wt % or less Al, at least one element selected from the group consisting of:
10.0 wt % or less Ni,
10.0 wt % or less Cu, and
10.0 wt % or less Co, and the balance consisting of Fe and unavoidable impurities, with the following formula satisfied:

$$2Mn+.5Ni+.5\ Cu+.5Co \geqq 4\ wt\ \%;$$

quench-hardening the steel plate either immediately, or after reheating, after completion of the hot rolling so as to establish a quenched microstructure substantially composed of martensite, bainite or mixture thereof; and tempering the quench-hardened steel plate by heating at a heating rate of 0.3° C./sec or more to a temperature of not higher than $A_{C1}$+20° C. and holding at this temperature for a time of not more than 30 min.

In this process, the tempering temperature may be selected to be either not less than $A_{C1}$ or from 500° C. to $A_{C1}$.

According to the sixth aspect of the first invention of the present application, there is provided a process of producing a steel plate having a high toughness, low yield ratio and high fatigue strength, the process comprising the steps of:

hot-rolling a steel to form a steel plate, the steel consisting of:

0.02 to 0.5 wt % C, 0.02 to 10.0 wt % Mn, 0.01 to 1.0 wt % Si, 0.1 wt % or less Al, at least one element selected from the group consisting of:
10.0 wt % or less Ni,
10.0 wt % or less Cu, and
10.0 wt % or less Co, at least one element selected from the group consisting of:
3.0 wt % or less Cr,
3.0 wt % or less Mo,
0.1 wt % or less V,
0.1 wt % or less Nb,
0.1 wt % or less Ti,
0.003 wt % or less B, and
3.0 wt % or less W, and the balance consisting of Fe and unavoidable impurities, with the following formula being satisfied:

$$2Mn+.5Ni+.5\ Cu+.5Co \geqq 4 \text{ wt \%};$$

quench-hardening the steel plate either immediately, or after reheating, after completion of the hot rolling so as to establish a quenched microstructure substantially composed of martensite, bainite or mixture thereof; and tempering the quench-hardened steel plate by heating at a heating rate of 0.3° C./sec or more to a temperature of not higher than $A_{C1}$+20° C. and holding at this temperature for a time of not more than 30 min.

In this process, the tempering temperature may be selected to be either not less than $A_{C1}$ or from 500° C. to $A_{C1}$.

According to the first aspect of the second invention of the present application, there is provided a steel plate having a high toughness, low yield strength and high fatigue strength, the steel consisting of:

0.02 to 0.35 wt % C;

0.02 to 2.5 wt % Si;

0.30 to 3.5 wt % Mn;

0.002 to 0.10 wt % Al; and the balance consisting of Fe and unavoidable impurities: the steel having a metallographical microstructure substantially composed of ferrite, cementite, and 0.5 to 5% by area of martensite.

The ferrite is preferably a lath ferrite.

The cementite is preferably present in the form of a layer between the ferrite laths and in an amount of from 1 to 40% by area.

According to the second aspect of the second invention of the present invention, there is provided a steel plate having a high toughness, low yield strength and high fatigue strength, the steel consisting of:

0.02 to 0.35 wt % C;

0.02 to 2.5 wt % Si;

0.30 to 3.5 wt % Mn;

0.002 to 0.10 wt % Al;

at least one component selected from the group consisting of the components (a), (b), (c), (d), and (e) which are defined as;

(a) at least one component for grain refining and precipitation hardening selected from the subgroup consisting of,
0.002 to 0.10 wt % Nb, and
0.002 to 0.10 wt % Ti, (b) at least one component for improving quench-hardenability selected from the subgroup consisting of,
0.05 to 3.0 wt % Cu,
0.05 to 10.0 wt % Ni,
0.05 to 10.0 wt % Cr,
0.05 to 3.5 wt % Mo,
0.05 to 10.0 wt % Co, and
0.05 to 2.0 wt % W, (c) 0.002 to 0.10 wt % V as a component for precipitation hardening, (d) 0.003 to 0.0025 wt % B as a component for improving quench-hardenability, and (e) at least one component for making sulphur harmless selected from the subgroup consisting of,
0.002 to 0.10 wt % REM, and
0.0003 to 0.0030 wt % Ca the balance consisting of Fe and unavoidable impurities: the steel having a metallographical microstructure substantially composed of ferrite, cementite, and 0.5 to 5% by area of martensite.

The ferrite is preferably a lath ferrite.

The cementite is preferably present in the form of a layer between the ferrite laths, in an amount of from 1 to 40% by area.

According to the third aspect of the second invention of the present application, there is provided a steel plate having a high toughness, low yield strength and high fatigue strength, the steel consisting of:

0.02 to 0.35 wt % C;

0.02 to 2.5 wt % Si;

0.30 to 3.5 wt % Mn;

0.002 to 0.10 wt % Al; and the balance consisting of Fe and unavoidable impurities: the steel having a metallographical microstructure substantially composed of ferrite, cementite, and 1 to 30 % by volume of retained austenite.

The ferrite is preferably a lath ferrite.

The cementite is preferably present in the form of a layer between the ferrite laths, in an amount of from 1 to 40% by area.

According to the fourth aspect of the second invention of the present application, there is provided a steel plate having a high toughness, low yield strength and high fatigue strength, the steel consisting of:

0.02 to 0.35 wt % C;

0.02 to 2.5 wt % Si;

0.30 to 3.5 wt % Mn;

0.002 to 0.10 wt % Al;

at least one component selected from the group consisting of the components (a), (b), (c), (d), and (e) which are defined as;

(a) at least one component for grain refining and precipitation hardening selected from the subgroup consisting of,
0.002 to 0.10 wt % Nb, and
0.002 to 0.10 wt % Ti, (b) at least one component for improving quench-hardenability selected from the subgroup consisting of,
0.05 to 3.0 wt % Cu,
0.05 to 10.0 wt % Ni,
0.05 to 10.0 wt % Cr,
0.05 to 3.5 wt % Mo,
0.05 to 10.0 wt % Co, and
0.05 to 2.0 wt % W, (c) 0.002 to 0.10 wt % V as a component for precipitation hardening, (d) 0.003 to 0.0025 wt % B as a component for improving quench-hardenability, and (e) at least one component for making sulphur harmless selected from the subgroup consisting of, 0.002 to 0.10 wt % REM, and 0.0003 to 0.0030 wt % Ca the balance consisting of Fe and unavoidable impurities: the steel having a metallographical microstructure substantially composed of ferrite, cementite, and 1 to 30 % by volume of retained austenite.

The ferrite is preferably a lath ferrite.

The cementite is preferably present in the form of a layer between the ferrite laths, in an amount of from 1 to 40% by area.

The third invention of the present application provides a process of producing a steel plate according to the second invention of the present application.

According to the first aspect of the third invention of the present application, there is provided a process of producing a steel plate having a high toughness, low yield ratio and high fatigue strength, said process comprising the steps of:

preparing a hot-rolled steel plate consisting of:

0.02 to 0.35 wt % C;

0.02 to 2.5 wt % Si;

0.30 to 3.5 wt % Mn;

0.002 to 0.10 wt % Al; and the balance consisting of Fe and unavoidable impurities, said steel plate having a metallographical microstructure substantially composed of ferrite and cementite;

heating said steel plate sufficiently rapidly to prevent coarsening of said microstructure, to a temperature of $A_{C1}$ or higher but sufficiently low to ensure an austenite amount of not more than 30% by volume;

holding said steel plate at said temperature so that cementite present before, or generated during, said heating is partially transformed into austenite; and then cooling said steel plate to room temperature at a cooling rate which ensures establishment of a metallographical microstructure substantially composed of ferrite, cementite, and 0.5 to 5% by area of martensite.

According to the second aspect of the third invention of the present application, there is provided a process of producing a steel plate having a high toughness, low yield ratio and high fatigue strength, said process comprising the steps of:

preparing a hot-rolled steel plate consisting of:

0.02 to 0.35 wt % C;

0.02 to 2.5 wt % Si;

0.30 to 3.5 wt % Mn;

0.002 to 0.10 wt % Al;

at least one component selected from the group consisting of the components (a), (b), (c), (d), and (e) which are defined as;

(a) at least one component for grain refining and precipitation hardening selected from the subgroup consisting of, 0.002 to 0.10 wt % Nb, and 0.002 to 0.10 wt % Ti, (b) at least one component for improving quench-hardenability selected from the subgroup consisting of, 0.05 to 3.0 wt % Cu, 0.05 to 10.0 wt % Ni, 0.05 to 10.0 wt % Cr, 0.05 to 3.5 wt % Mo, 0.05 to 10.0 wt % Co, and 0.05 to 2.0 wt % W, (c) 0.002 to 0.10 wt % V as a component for precipitation hardening, (d) 0.003 to 0.0025 wt % B as a component for improving quench-hardenability, and (e) at least one component for making sulphur harmless selected from the subgroup consisting of, 0.002 to 0.10 wt % REM, and 0.0003 to 0.0030 wt % Ca; and the balance consisting of Fe and unavoidable impurities: said steel having a metallographical microstructure substantially composed of ferrite and cementite;

heating said steel plate sufficiently rapidly to prevent coarsening of said microstructure, to a temperature of $A_{C1}$ or higher but sufficiently low to ensure an austenite amount of not more than 30% by volume;

holding said steel plate at said temperature so that cementite present before, or generated during, said heating is partially transformed into austenite; and then cooling said steel plate to room temperature at a cooling rate which ensures establishment of a metallographical microstructure substantially composed of ferrite, cementite, and 0.5 to 5% by area of martensite.

According to the third aspect of the third invention of the present application, there is provided a process of producing a steel plate having a high toughness, low yield ratio and high fatigue strength, said process comprising the steps of:

preparing a hot-rolled steel plate consisting of:

0.02 to 0.35 wt % C;

0.02 to 2.5 wt % Si;

0.30 to 3.5 wt % Mn;

0.002 to 0.10 wt % Al; and the balance consisting of Fe and unavoidable impurities, said steel plate having a metallographical microstructure substantially composed of lath-form crystals, such as as-quenched bainite or martensite, that contain dissolved carbon and iron carbides;

heating said steel plate sufficiently rapidly to prevent coarsening of said microstructure, to a temperature of not lower than $A_{C1}$ but sufficiently low to ensure an austenite amount of not more than 30% by volume;

holding said steel plate at said temperature so that cementite present before, or generated during, said heating is partially transformed into austenite; and then cooling said steel plate to room temperature at a cooling rate which ensures establishment of a metallographical microstructure substantially composed of ferrite, cementite, and 0.5 to 5% by area of martensite.

According to the fourth aspect of the third invention of the present application, there is provided a process of producing a steel plate having a high toughness, low yield ratio and high fatigue strength, said process comprising the steps of:

preparing a hot-rolled steel plate consisting of:

0.02 to 0.35 wt % C;

0.02 to 2.5 wt % Si;

0.30 to 3.5 wt % Mn;

0.002 to 0.10 wt % Al;

at least one component selected from the group consisting of the components (a), (b), (c), (d), and (e) which are defined as;

(a) at least one component for grain refining and precipitation hardening selected from the subgroup consisting of, 0.002 to 0.10 wt % Nb, and 0.002 to 0.10 wt % Ti, (b) at least one component for improving quench-hardenability selected from the subgroup consisting of, 0.05 to 3.0 wt % Cu, 0.05 to 10.0 wt % Ni, 0.05 to 10.0 wt % Cr, 0.05 to 3.5 wt % Mo, 0.05 to 10.0 wt % Co, and 0.05 to 2.0 wt % W, (c) 0.002 to 0.10 wt % V as a component for precipitation hardening, (d) 0.003 to 0.0025 wt % B as a component for improving quench-hardenability, and (e) at least one component for making sulphur harmless selected from the subgroup consisting of, 0.002 to 0.10 wt % REM, and 0.0003 to 0.0030 wt % Ca; and the balance consisting of Fe and unavoidable impurities, said steel plate having a metallographical microstructure substantially composed of lath-form crystals, such as as-quenched bainite or martensite, that contain dissolved carbon and iron carbides;

heating said steel plate sufficiently rapidly to prevent coarsening of said microstructure, to a temperature of $A_{C1}$ or higher but sufficiently low to ensure an austenite amount of not more than 30% by volume;

holding said steel plate at said temperature so that cementite present before, or generated during, said heating is partially transformed into austenite; and then cooling said steel plate to room temperature at a cooling rate which ensures establishment of a metallographical microstructure substantially composed of ferrite, cementite, and 0.5 to 5% by area of martensite.

According to the fifth aspect of the third invention of the present application, there is provided a process of producing a steel plate having a high toughness, low yield ratio and high fatigue strength, said process comprising the steps of:

preparing a hot-rolled steel plate consisting of:

0.02 to 0.35 wt % C;

0.02 to 2.5 wt % Si;

0.30 to 3.5 wt % Mn;

0.002 to 0.10 wt % Al; and the balance consisting of Fe and unavoidable impurities, said steel plate having a metallographical microstructure substantially composed of ferrite and cementite;

heating said steel plate sufficiently rapidly to prevent coarsening of said microstructure, to a temperature of not lower than $A_{C1}$ but sufficiently low to ensure an austenite amount of not more than 30% by volume;

holding said steel plate at said temperature so that cementite present before, or generated during, said heating is partially transformed into austenite; and then cooling said steel plate to room temperature at a cooling rate which ensures establishment of a metallographical microstructure substantially composed of ferrite, cementite, and 1 to 30% by volume of austenite.

According to the sixth aspect of the third invention of the present application, there is provided a process of producing a steel plate having a high toughness, low yield ratio and high fatigue strength, said process comprising the steps of:

preparing a hot-rolled steel plate consisting of:

0.02 to 0.35 wt % C;

0.02 to 2.5 wt % Si;

0.30 to 3.5 wt % Mn;

0.002 to 0.10 wt % Al;

at least one component selected from the group consisting of the components (a), (b), (c), (d), and (e) which are defined as;

(a) at least one component for grain refining and precipitation hardening selected from the subgroup consisting of, 0.002 to 0.10 wt % Nb, and 0.002 to 0.10 wt % Ti, (b) at least one component for improving quench-hardenability selected from the subgroup consisting of, 0.05 to 3.0 wt % Cu, 0.05 to 10.0 wt % Ni, 0.05 to 10.0 wt % Cr, 0.05 to 3.5 wt % Mo, 0.05 to 10.0 wt % CO, and 0.05 to 2.0 wt % W, (c) 0.002 to 0.10 wt % V as a component for precipitation hardening, (d) 0.003 to 0.0025 wt % B as a component for improving quench-hardenability, and (e) at least one component for making sulphur harmless selected from the subgroup consisting of, 0.002 to 0.10 wt % REM, and 0.0003 to 0.0030 wt % Ca; and the balance consisting of Fe and unavoidable impurities, said steel plate having a metallographical microstructure substantially composed of ferrite and cementite;

heating said steel plate sufficiently rapidly to prevent coarsening of said microstructure, to a temperature of not lower than $A_{C1}$ but sufficiently low to ensure an austenite amount of not more than 30% by volume;

holding said steel plate at said temperature so that cementite present before, or generated during, said heating is partially transformed into austenite; and then cooling said steel plate to room temperature at a cooling rate which ensures establishment of a metallographical microstructure substantially composed of ferrite, cementite, and 1 to 30% by volume of austenite.

According to the seventh aspect of the third invention of the present application, there is provided a process of producing a steel plate having a high toughness, low yield ratio and high fatigue strength, said process comprising the steps of:

preparing a hot-rolled steel plate consisting of:

0.02 to 0.35 wt % C;

0.02 to 2.5 wt % Si;

0.30 to 3.5 wt % Mn;

0.002 to 0.10 wt % Al; and the balance consisting of Fe and unavoidable impurities, said steel plate having a metallographical microstructure substantially composed of lath-form crystals, such as as-quenched bainite or martensite, that contain dissolved carbon and iron carbides;

heating said steel plate sufficiently rapidly to prevent coarsening of said microstructure, to a temperature of $A_{C1}$ or higher but sufficiently low to ensure an austenite amount of not more than 30% by volume;

holding said steel plate at said temperature so that cementite present before, or generated during, said heating is partially transformed into austenite; and then cooling said steel plate to room temperature at a cooling rate which ensures establishment of a metallographical microstructure substantially composed of ferrite, cementite, and 1 to 30% by volume of austenite.

According to the eighth aspect of the third invention of the present application, there is provided a process of producing a steel plate having a high toughness, low yield ratio and high fatigue strength, said process comprising the steps of:

preparing a hot-rolled steel plate consisting of:

0.02 to 0.35 wt % C;

0.02 to 2.5 wt % Si;

0.30 to 3.5 wt % Mn;

0.002 to 0.10 wt % Al;

at least one component selected from the group consisting of the components (a), (b), (c), (d), and (e) which are defined as;

(a) at least one component for grain refining and precipitation hardening selected from the subgroup consisting of, 0.002 to 0.10 wt % Nb, and 0.002 to 0.10 wt % Ti, (b) at least one component for improving quench-hardenability selected from the subgroup consisting of, 0.05 to 3.0 wt % Cu, 0.05 to 10.0 wt % Ni, 0.05 to 10.0 wt % Cr, 0.05 to 3.5 wt % Mo, 0.05 to 10.0 wt % CO, and 0.05 to 2.0 wt % W, (c) 0.002 to 0.10 wt % V as a component for precipitation hardening, (d) 0.003 to 0.0025 wt % B as a component for improving quench-hardenability, and (e) at least one component for making sulphur harmless selected from the subgroup consisting of, 0.002 to 0.10 wt % REM, and 0.0003 to 0.0030 wt % Ca; and the balance consisting of Fe and unavoidable impurities, said steel plate having a metallographical microstructure substantially composed of lath-form crystals, such as as-quenched bainite or martensite, that contain dissolved carbon and iron carbides;

heating said steel plate sufficiently rapidly to prevent coarsening of said microstructure, to a temperature of $A_{C1}$ or higher but sufficiently low to ensure an austenite amount of not more than 30% by volume;

holding said steel plate at said temperature so that cementite present before, or generated during, said heating is partially transformed into austenite; and then cooling said steel plate to room temperature at a cooling rate which ensures establishment of a metallographical microstructure substantially composed of ferrite, cementite, and 1 to 30% by volume of austenite.

The present invention establishes a fine dispersion of martensite, retained austenite or cementite in a well-preserved fine structure of tempered martensite or tempered bainite to provide a low yield ratio, high tension steel plate having a good strength and toughness.

The basic concept of the present invention is as follows. From metallographical point of view, the strength and toughness of a steel produced by quench-hardening (including direct quenching) and tempering primarily depends upon the fineness of the microstructure of the steel. A steel in the as-quenched state usually has a metallographical microstructure composed of martensite and bainite phases having fine crystal grains. This microstructure provides high strength. The as-quenched microstructure, however, has poor toughness in contrast to the high strength, because of it is supersaturated with a large number of carbon atoms. Thus, a quench-hardened steel is then usually tempered. Tempering is generally effected by placing a steel plate in a heat-treatment furnace held at a temperature predetermined for the tempering treatment to heat the steel plate to a temperature below the $A_{C1}$ point of the steel and by holding the steel plate at this temperature for several tens of minutes. Thus, a tempering treatment requires a very long time including a time elapsed during heating to the tempering temperature. The tempered steel has a microstructure composed of tempered martensite or tempered bainite. The thus-tempered steel has high yield strength, and often has a yield ratio greater than 90%, because cementite and other carbides having precipitated during the tempering effectively fix mobile dislocations in the steel.

In contrast, as-quenched martensite and retained austenite have a low yield strength and resulting low yield ratio, because of a great number of dislocations contained in crystal grains. Moreover, the retained austenite absorbs solute atoms from the martensite in accordance with the solubility difference therebetween (or between austenite and ferrite), thereby decreasing the amount of solute atoms in the martensite that raise the yield strength of the martensite.

Therefore, to provide a steel with a low yield ratio, it is considered necessary that retained austenite be generated and prevented from being decomposed during tempering and that dislocations in martensite and retained austenite are prevented from disappearing by recovery. This allows one to conclude that a steel plate is produced when a steel is tempered at a temperature of $A_{C1}$ thereof or higher to cause the steel to be partially austenitized, and during the subsequent cooling stage, the thus-generated austenite is either maintained as retained austenite or retransformed to martensite to establish a mixed microstructure composed of tempered martensite, tempered bainite, and the generated retained austenite or retransformed martensite.

This procedure, however, cannot be successfully carried out with the conventional steel composition and tempering method, however, as the generated austenite is not retained but is decomposed. Moreover, the portion of the steel microstructure that was martensite or bainite at the time of quenching will lose its substantial content of dislocations in crystal grains by recovery and recrystallization, and occasionally becomes coarse ferrite which is neither preferred from the view point of strength and toughness nor provides a low yield ratio.

The present inventors studied many conditions of heat treatment and found that the yield ratio of a steel can be easily lowered with an improved strength and toughness ensured when the steel is tempered at a temperature of $A_{C1}$ or higher by a rapid heating to and short time holding at the temperature.

The present inventors also studied many chemical components and heat treatment conditions and found that the yield ratio of a steel can be easily lowered with a good strength and toughness maintained, when Mn, Ni, Cu and Co are contained in the steel in a total amount greater than a selected amount to stabilize austenite phase such that a suitable amount of retained austenite is favorably generated upon quench-hardening and the generated retained austenite is hard to decompose and when tempering is carried out by a rapid heating such as to suppress the decomposition of austenite and the recrystallization and recovery of martensite.

According to this concept, the present invention enables the production of a low yield ratio, high tension steel plate having a good strength and toughness by preserving the fine, dislocation-rich microstructure of martensite or bainite and establishing a mixed microstructure of the fine tempered martensite, tempered bainite, retained austenite and cementite (including those having concentrated solute atoms generated by decomposition of austenite).

The effect of the present invention is considered brought about by the fact that the tempering carried out at a temperature of $A_{C1}$ or higher generates austenite finely dispersed on the martensite lath boundaries or the like (cementite precipitated at a temperature below $A_{C1}$ provides nuclei for the austenite), that the generated austenite becomes martensite, retained austenite, cementite, or mixture thereof during the subsequent cooling, and that the thus-generated martensite and retained austenite contain a great number of dislocations which lowers the yield point and also increases the tensile strength. The portion of the microstructure that was not austenitized also contributes to the increase in the steel toughness through an improvement of strength by the fact that the rapid heating and short time tempering cause carbides to be distributed in the steel microstructure and that the dislocations introduced by transformations such as martensite transformations and dislocations inherited from worked austenite provide a great number of dislocations, and occasionally through an improvement of ductility by mobile dislocations.

Regarding the decrease in yield ratio, another effect is expected that the portion of the microstructure that was austenitized absorbs solute elememnts from the rest of the microstructure and decreases the amount thereof in accordance with the solubility difference between austenite and martensite (ferrite). This effect is valid after the austenitized portion becomes ferrite and cementite.

According to this concept, the present invention enables the production of a low yield ratio, high tension steel plate having high strength and toughness, by preserving the fine microstructure of martensite or bainite, austenitizing a minute part thereof, and rendering this part to martensite, retained austenite, cementite, or mixture thereof during cooling, that is dispersed in tempered martensite or tempered bainite.

From the view point of productivity, an increased heating rate and reduced holding time within 15 minutes as shown in FIG. 1 significantly reduces the time interval actually required to effect tempering and thereby remarkably improves the productivity.

Namely, the present invention enables a low yield ratio, high tension steel plate having good strength and toughness to be produced in an extremely short time in comparison with the conventional process.

The yield ratio generally depends upon the steel microstructure and can mostly be about 70% or 90% when the microstructure is substantially composed of ferrite or martensite, respectively. Namely, there is a general tendency that the higher the tensile strength, the higher the yield ratio also. Thus, the yield ratio must be evaluated for steels of the same grade and exhibiting about the same level of tensile strength and must not be discussed just in terms of the absolute value without such provision. The lath ferrite, as referred to herein, is a ferritic microstructure in the form of a lath observed in an as-quenched microstructure by transmission electron microscopy, that has been subjected to heat treatment such as tempering, so that solute carbons have precipitated as carbides to establish distinct cementite and ferrite phases. The cementite in the form of a layer between ferrite laths, as referred to herein, is the cementite 2 precipitated along boundaries between ferrite laths 1 as shown in FIG. 2, which also shows as-transformed martensite 3 and cementite 4 present inside the ferrite lath (cementite present inside the crystal grains). The percentages of the respective phases are determined by measuring the area percentage on the microphotographs taken by a transmission electron microscope for the steel plate samples. The retained austenite amount is determined by X-ray measurement (wide angle goniometry).

Steel plates having a tensile strength of 60 kg/mm$^2$ or more are mostly produced by usual quench-hardening and tempering or direct quench-hardening and tempering and usually have a microstructure composed of martensite, bainite, or mixture thereof. The tempered steel plate generally has an extremely high yield ratio of about 90%, which is not advantageous for the resistance to earthquake. Therefore, the yield ratio was conventionally lowered by generating a certain amount of ferrite to provide a mixed structure of soft ferrite and hard bainite or martensite phases. This procedure, however, involves air cooling allowing formation of coarse ferrite and thereby lowering the steel toughness. A solution to this problem was proposed, in which a quench-hardened or tempered steel is heat-treated at a temperature of $A_{C1}$ or higher so that the lath structure of the tempered bainite or martensite is recrystallized to lower the yield strength and thereby lower the yield ratio. This procedure, however, has a problem in that the lath structure must be preserved in its initial state in order to ensure good toughness, and thus, good toughness is lost when the lath structure is changed in morphology by recrystallization.

Steels having a tensile strength of 50 kg/mm$^2$ or higher and lower than 60 kg/mm$^2$ are mostly produced either by rolling or by normalization or by accelerated cooling after rolling, and thus, mostly have a ferrite-pearlite or ferrite-bainite mixed microstructure. These steels generally have a relatively low yield ratio of about 70%. To further lower the yield ratio, a coarse ferrite is either generated upon transformation or ferrite is coarsened by heat treatment in a temperature range of not lower than $A_{C1}$, in the same manner as recited above, and these procedures consequently lower the steel toughness.

These steels have a relatively high fatigue strength corresponding to their high tensile strength. The fatigue strength, however, is not substantially varied by the steel chemical composition when the steels are on the same strength level, so that the microstructural adjustment provides no effective procedure to improve the fatigue strength.

The present inventors have found that steels having specific microstructures have a low yield ratio and high fatigue strength. One type of such microstructure is essentially composed of ferrite and cementite and containing a selected amount of as-transformed martensite. A preferred microstructure has about 0.5 micron-wide fine ferrite laths, such as those usually observed in a quench-hardened and tempered microstructure, with the cementite dispersed within the laths or on the lath boundaries. In a quench-hardened and tempered microstructure, the as-quenched martensite is rarely observed because it is decomposed to ferrite and cementite. The yield ratio will be remarkably lowered when 0.5 to 5% martensite is contained in the above-mentioned microstructure of lath ferrite and cementite by some procedure such as heating to a temperature of immediately above $A_{C1}$ followed by rapid cooling. This is thought to be because the as-quenched martensite lowers the yield point, increases the tensile strength, and simultaneously resists propagation of fatigue cracks. Another type of microstructure is essentially composed of ferrite and cementite and containing a selected amount of retained austenite. A preferred microstructure has about 0.5 micron-wide fine ferrite laths, such as those usually observed in a quench-hardened and tempered microstructure, with the cementite dispersed within the laths or on the lath boundaries. In a quench-hardened and tempered microstructure, the retained austenite is decomposed and rarely observed. Reduction of yield ratio and improvement of fatigue strength will be remarkable when 1% or more by volume of martensite is contained in the above-mentioned microstructure of lath ferrite and cementite by some procedure such as heating to a temperature of immediately above $A_{C1}$ followed by cooling at a selected cooling rate. This is considered because the retained austenite naturally has strong tendency to work hardening, thereby reducing the yield ratio and improving the tensile strength.

It is also considered that the γ-phase naturally causes no brittle cracks, thereby serving as a resistance to propagation of fatigue cracks.

Fatigue limit is a measure of the fatigue strength. It is a general tendency that the fatigue limit simply becomes greater as the tensile strength or yield strength obtained by tensile test becomes greater. Usual steels have fatigue limits as defined by the following formula, for example, as reported by Takahashi et al., "Nihon Kikai Gakkai Rombunsyuu", vol.38, No. 310, 1972, page 1154:

$$\sigma o = .382\ \sigma y + 23.9,$$

where σ o is fatigue limit (kgf/mm$^2$) and σ y is yield strength (kgf/mm$^2$).

Therefore, if a fatigue limit greater than a value expected from this formula is obtained for one and the same steel, it must be an improvement in fatigue strength brought about by the present invention. Note that this formula can be valid when $\sigma y \geqq 45$ kgf/mm$^2$.

The chemical composition of the present inventive steel is limited for the following reasons.

Carbon effectively strengthens steels, but this effect is not ensured when the carbon content is less than 0.02%. Carbon deteriorates the weldability of steel when present in an amount of more than 0.5%.

The carbon content should not exceed 0.35% when the weldability is of particular significance.

Silicon is an effective deoxidizer and strengthening element, but this effect is not ensured when the silicon content is less than 0.01%. Usual silicon content is 0.02% or more. However, a silicon content of more than 2.5% causes deterioration of the steel surface appearance.

The silicon content should not exceed 1.0% when the surface appearance is of particular significance.

Manganese effectively strengthens steels, but this effect is not completely ensured when the manganese content is less than 0.02%. However, a manganese content of more than 10.0% deteriorates the workability of steel. Preferably, the manganese content is in the range of from 0.30% to 3.5%.

Aluminum is added as a deoxidizer. This effect is small when the aluminum content is less than 0.002%. An aluminum content of more than 0.10% deteriorates the steel surface appearance.

Both titanium and niobium effectively function in refining crystal grains and strengthening by precipitation when added in a small amount. Generally, these elements are added in an amount of 0.002% or more. To ensure the toughness of weld, the titanium and niobium contents are limited to 0.10% or less, respectively.

Copper, nickel, chromium, molybdenum, cobalt, and tungsten all improve the quench-hardenability of steel and may be used in the present invention to improve the steel strength. These elements when used in an excessive amount, however, deteriorate the steel toughness and weldability and should be used within the following limits: Cu≧10.0%, Ni≧10.0%, Cr≧3.0%, Mo≧3.0%, Co≧10.0%, and W≧3.0%. Preferred ranges are: Cu 0.05 to 3.0%, Ni 0.05 to 10.0%, Cr 0.05 to 10.0%, Mo 0.05 to 3.5%, Co 0.05 to 10.0%, and W 0.05 to 2.0%.

Preferably, the total amount of Ni, Mn, Cu and Co fulfills the formula: 2Mn+2.5Ni+1.5 Cu+0.5 Co≧4. This is because these elements lower the $A_{C1}$ point, and to ensure this effect, it is necessary that these elements are present in an amount of 2% or more in terms of the converted Mn content.

Vanadium is effective in increasing the steel strength by precipitation strengthening. The upper limit of the vanadium content is 0.10%, because vanadium damages the steel toughness when excessively present. Usually, vanadium is added in an amount of 0.002% or more.

Boron improves the quench-hardenability of steel and may be used in the present invention to increase the steel strength. Boron when excessively present deteriorates the steel toughness due to an increased amount of boron precipitates. Therefore, the upper limit of the boron content is 0.003%. Preferably, the boron content is from 0.0003% to 0.0025%.

REM and calcium are effective in making sulphur harmless. These components are usually used in amounts of REM 0.002 to 0.10% and Ca 0.0003 to 0.0030%, because these elements deteriorate the toughness when excessively present.

Process conditions according to the present invention will be described.

The present invention is effective on steel billets obtained through casting performed under any casting conditions and does not need any limitation to the casting condition. The cast steel may either not be cooled but be directly hot-rolled or may be once cooled, then reheated to $A_{C1}$ or above and hot-rolled. The present invention does not need any limitation to rolling and post-rolling cooling, because the effect of the present invention is not lost under any rolling and cooling conditions. It should be noted that a fine dispersion of crystal grains and carbides is established during tempering according to the present invention. To best utilize this effect, it is preferred that an as-quench-hardened microstructure is composed of martensite and bainite and has fine crystal grains.

According to one aspect of the present invention, tempering is performed at a temperature of $A_{C1}$ or higher, because carbides are not austenitized when the tempering temperature is lower than this. The tempering is performed at a heating rate of 1° C./sec or higher and for a time of holding within a temperature range above $A_{C1}$ of 15 min or less, because slower heating and longer holding time would cause recovery of dislocations during heating, coarsening of microstructure and precipitate, and precipitation of solute atoms, thereby failing to improve the strength and toughness, and would also cause enhances coarsening of austenite leading to coarse microstructure after cooling thereby deteriorating the toughness.

According to another aspect of the present invention, tempering is performed at a temperature of not higher than $A_{C1}$+80° C., because higher temperatures causes coarsening of the austenitized portions, recovery of dislocations in martensite, recrystallization, coarsening of precipitates, thereby failing to improve the strength and toughness and/or to lower the yield ratio. The tempering is performed for a holding time of 30 min or less for the same reason.

According to a further aspect of the present invention, tempering is performed at a temperature of not higher than $A_{C1}$+20° C., because higher temperatures enhances austenitizing of the martensite and bainite portions, thereby causing uneven and coarsened as-quench-hardened microstructure.

From this point of view the tempering is preferably performed at a temperature of not higher than $A_{C1}$, but temperatures of not higher than $A_{C1}$+20° C. can be used in the present invention because it meets the object of the present invention that a small amount of austenite is generated during tempering and either is retained unchanged as austenite or is changed to martensite containing a great number of dislocations. The tempering is performed at a heating rate of 1° C./sec or higher and for a holding time of 30 min or less, because a slower heating or longer holding time causes decomposition of retained austenite, recovery of dislocations, and coarsening of microstructure and precipitates, thereby failing to improve the strength and toughness and/or to lower the yield ratio.

The steel microstructure of the present invention is limited for the following reasons.

According to one aspect of the present invention, the steel microstructure is essentially composed of a mixture of ferrite and cementite and contains from 0.5% to 5% as-transformed martensite. The as-transformed martensite having no carbide precipitates such as cementite is excessively hard and has a poor toughness.

The ferrite may be in any forms including granules and laths, although the lath form having a width of about 0.5 microns or less such as is observed in a tempered martensite is preferred.

The yield ratio is remarkably reduced when the cementite forms layers disposed between the ferrite laths and is present in an amount of 1% by area or more. The cementite occasionally deteriorates the toughness when present in an amount of more than 40%. In such a case, a pearlite is also effective.

The yield ratio reduction is caused by a reduced hardness lower than that of as-quench-hardened martensite and by an increase in the tensile strength. The yield ratio is lowered when certain amounts of as-transformed martensite and cementite phases are present, although remarkable lowering is obtained when these phases are disposed on the boundaries between fine laths to suppress piling up of dislocations. This effect is insignificant when the amount of as-transformed martensite is less than 0.5% whereas the toughness is deteriorated when the amount of as-transformed martensite is more than 5%. Thus, the amount of as-transformed martensite must be in the range of from 0.5 to 5%.

According to another aspect of the present invention, a microstructure is essentially composed of a mixture of ferrite and cementite phases and containing 1 to 30% by volume of retained γ phase. The as-quench-hardened martensite having no carbide precipitates such as cementite is excessively hard and has poor fatigue properties.

The ferrite may be in any forms including granules and laths, although the lath form having a width of about 0.5 microns or less such as is observed in a tempered martensite is preferred.

The fatigue strength is remarkably improved when the cementite forms layers disposed between the ferrite laths and is present in an amount of 1% by area or more. The cementite occasionally deteriorates the toughness when present in an amount of more than 40%. In such a case, a pearlite is also effective.

The fatigue strength is improved because retained austenite and cementite phases resist the propagation of fatigue cracks. The fatigue strength is improved when certain amounts of as-transformed martensite and cementite phases are present, although remarkable improvement is obtained when these phases are disposed on the boundaries between fine laths to effectively suppress propagation of fatigue cracks along the boundaries. This effect is insignificant when the amount of retained austenite is less than 1% by volume whereas the fluctuation of strength becomes obvious when the amount of retained austenite is more than 30% by volume. Thus, the amount of retained austenite must be in the range of from 1 to 30% by volume.

According to a further aspect of the present invention, the steel microstructure is essentially composed of a mixture of ferrite and cementite and contains from 0.5% to 5% martensite. A microstructure has a poor toughness when it is mainly composed of the as-quench-hardened martensite, which has no carbide precipitates such as cementite and is excessively hard.

The ferrite may be in any forms including granules and laths, although the lath form having a width of about 0.5 microns or less such as observed in a tempered martensite is preferred.

The fatigue strength is remarkably improved when the cementite forms layers disposed between the ferrite laths and is present in an amount of 1% by area or more. The cementite occasionally deteriorates the toughness when present in an amount of more than 40%. This effect obtained by the cementite layers disposed between the ferrite laths is also valid in a microstructure mainly composed of pearlite.

The fatigue strength is improved because a dispersion of hard as-quench-hardened martensite resist the propagation of fatigue cracks. The fatigue crack propagation is suppressed when a certain amount of hard as-quench-hardened martensite is present, although the fatigue strength is remarkably improved when the martensite is is disposed on the boundaries between fine laths. The resistance to fatigue crack propagation is further increased by a synergistic effect of the cementite layers and the martensite dispersion on the boundaries between fine ferrite laths. This effect is insignificant when the amount of martensite is less than 0.5% by area whereas the toughness is deteriorated when the amount is more than 5% by area. Thus, the amount of as-transformed or as-quench-hardened martensite must be in the range of from 0.5 to 5% by area.

According to another aspect of the present invention, the steel microstructure is essentially composed of a mixture of ferrite and cementite phases and contains from 1% to 30% by volume of retained austenite. The as-quench-hardened martensite having no precipitates of cementite or other carbides is excessively hard and provides poor toughness. The ferrite may be in any forms including granules and laths, although the lath form having a width of about 0.5 microns or less such as observed in a tempered martensite is preferred. The fatigue strength is remarkably improved when the cementite forms layers disposed between the ferrite laths and is present in an amount of 1% by area or more. The cementite occasionally deteriorates the toughness when present in an amount of more than 40%. This effect obtained by the cementite layers disposed between the ferrite laths is also valid in a microstructure mainly composed of pearlite.

The yield ratio is improved because the retained austenite naturally has a high work hardening coefficient, thereby lowering the yield point while raising the tensile strength. The yield ratio is reduced when certain amounts of retained γ and cementite phases are present, although remarkable reduction is obtained when these phases are disposed on the boundaries between fine laths. This effect is insignificant when the amount of retained austenite is less than 1% by volume whereas the fluctuation of strength becomes obvious when the amount of retained austenite is more than 30% by volume. Thus, the amount of retained austenite must be in the range of from 1 to 30% by volume.

It has been found that a microstructure of bainite or martensite obtained when quench-hardening a steel having a chemical composition within the range of the present invention is composed of an aggregate of crystals in the form of a lath having a width of 1 micron or less and contains solute carbon and iron carbides. Some iron carbides present in an as-quench-hardened state or in the initial stage of a heating therefrom may have a composition different from that of cementite, and are substantially converted to cementite.

DESCRIPTION OF THE PREFERRED EMBODIMENTS

Figure 1:
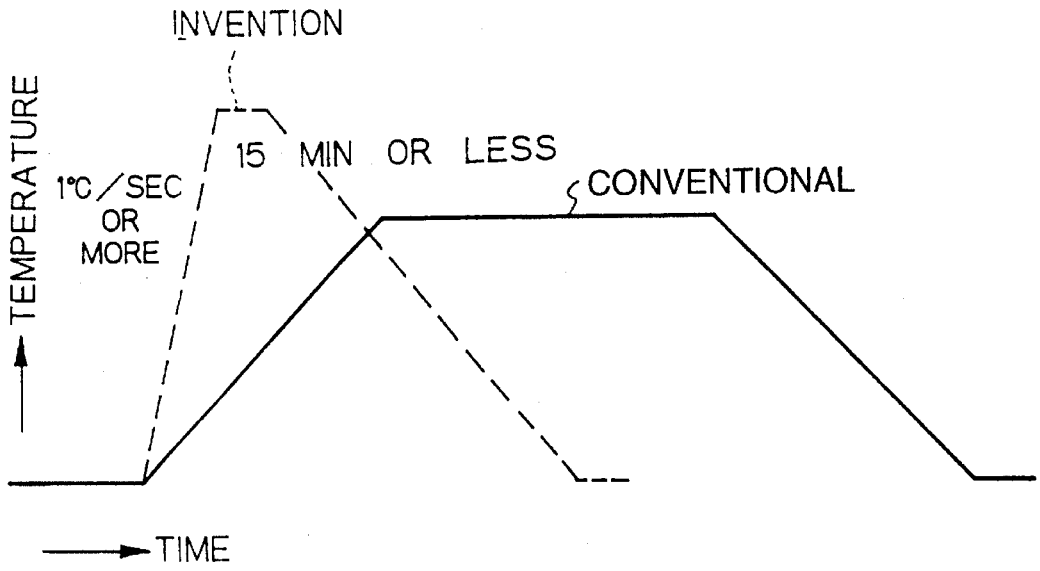
FIG. 1 is a chart showing a temperature-time cycle used in tempering according to the present invention.
Figure 2:
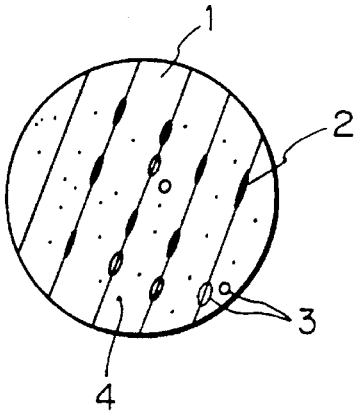
FIG. 2 schematically illustrates a metallographical microstructure according to the present invention.

Examples 1 to 3 of the first invention of the present application will be described below.

EXAMPLE 1

Tables 1 and 2 show the chemical compositions of the steels of the examples according to the present invention. When the steels having these chemical compositions were produced under the process conditions shown in Tables 2 and 3, the strength, toughness and time required for tempering as summarized in Tables 2 and 3 were obtained. Note that, in Tables 3 and 4, the underlined items are outside the specified ranges of the present invention.

These results clearly show that the present invention is advantageous in that, in comparison with the conventional process, the process according to the present invention has a higher productivity and enables production of a low yield ratio steel plate having an improved tensile strength and toughness. The present invention remarkably improves the productivity by producing a low yield ratio steel plate having an improved strength and toughness in a very short time.

EXAMPLE 2

Tables 5 and 6 show the chemical compositions of the steels of the examples according to the present invention. When the steels having these chemical compositions were produced under the process conditions shown in Table 7, the strength, toughness, yield ratio and treatment time as summarized in Table 8 were obtained. Note that, in Tables 6 and 7, the underlined items are outside the specified ranges of the present invention.

These results clearly show that the present invention is advantageous in that, in comparison with that of the conventional process, the process according to the present invention enables production of a low yield ratio steel plate having an improved tensile strength and toughness in a reduced time. The present invention enables producing a low yield ratio steel plate having an improved strength and toughness in a very short time.

EXAMPLE 3

Tables 9 and 10 show the chemical compositions of the steels of the examples according to the present invention. When the steels having these chemical compositions were produced under the process conditions shown in Table 11, the strength, toughness, yield ratio and treatment time as summarized in Table 12 were obtained. Note that, in Tables 10 to 12, the underlined items are outside the specified ranges of the present invention.

These results clearly show that the present invention is advantageous in that, in comparison with that of the conventional process, the process according to the present invention enables production of a low yield ratio steel plate having a distinctively improved tensile strength and toughness in a reduced time. The present invention enables producing a low yield ratio steel plate having an improved strength and toughness in a very short time.

Examples 4 to 7 of the second and third inventions of the present application will be described below.

EXAMPLE 4

The steels having the chemical compositions shown in Table 13 were used to produce the inventive and comparative samples having the microstructures shown in Tables 14 to 18, which were then subjected to a mechanical test to yield the tensile strengths and the impact properties shown in Tables 14 to 18. The tensile and impact tests were carried out by using JIS No. 4 test pieces. To determine the steel microstructures, transmission electron micrographs of the samples from steel plates were subjected to measurement of percent by area for different phases.

Figure 3:
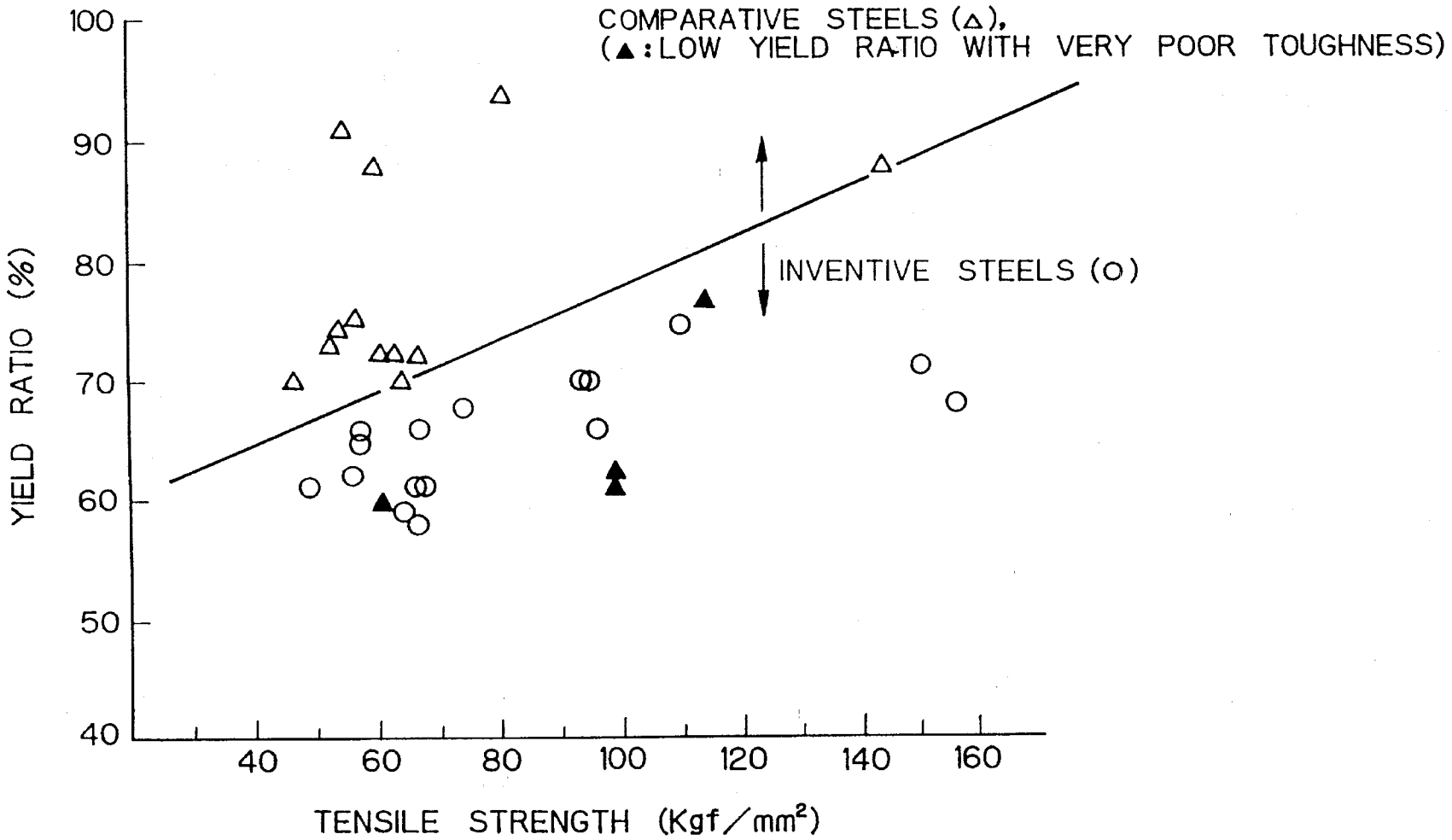
FIG. 3 is a graph showing the relationship between the tensile strength and the yield ratio.

It is obvious from Tables 14 to 18 that the present invention is advantageous in that the steels according to the present invention had a lowered yield ratio and improved fatigue strength with no deterioration in toughness. FIG. 3 shows the relationship between the tensile strength and the yield ratio for the samples tested. The steels according to the present invention have a reduced yield ratio with the strength level kept unchanged.

EXAMPLE 5

The steels having the chemical compositions shown in Table 13 were used to produce the inventive and comparative samples having the microstructures shown in Tables 20 to 24, which were then subjected to a fatigue test to yield the fatigue strength properties shown in Tables 20 to 24. Tensile and impact tests were carried out by using JIS No. 4 test pieces. The fatigue test was performed by using tensile specimens having a 10 mm diameter, 22 mm long parallel portion with the surface polished in the tensile direction. S-N diagrams were obtained under repeated loads with different intensities and a stress ratio of zero. The results were used to determine the fatigue limits which are summarized in Tables 20 to 24. The proportions of ferrite and cementite phases in the steel microstructure were determined by measurement of the area percentage on a transmission electron micrograph of a replica from a steel plate sample. The amount of retained austenite was determined by X-ray analysis (wide angle goniometric analysis).

It is clear from Tables 20 to 24 that the present invention is advantageous in improving the fatigue strength.

Figure 4:
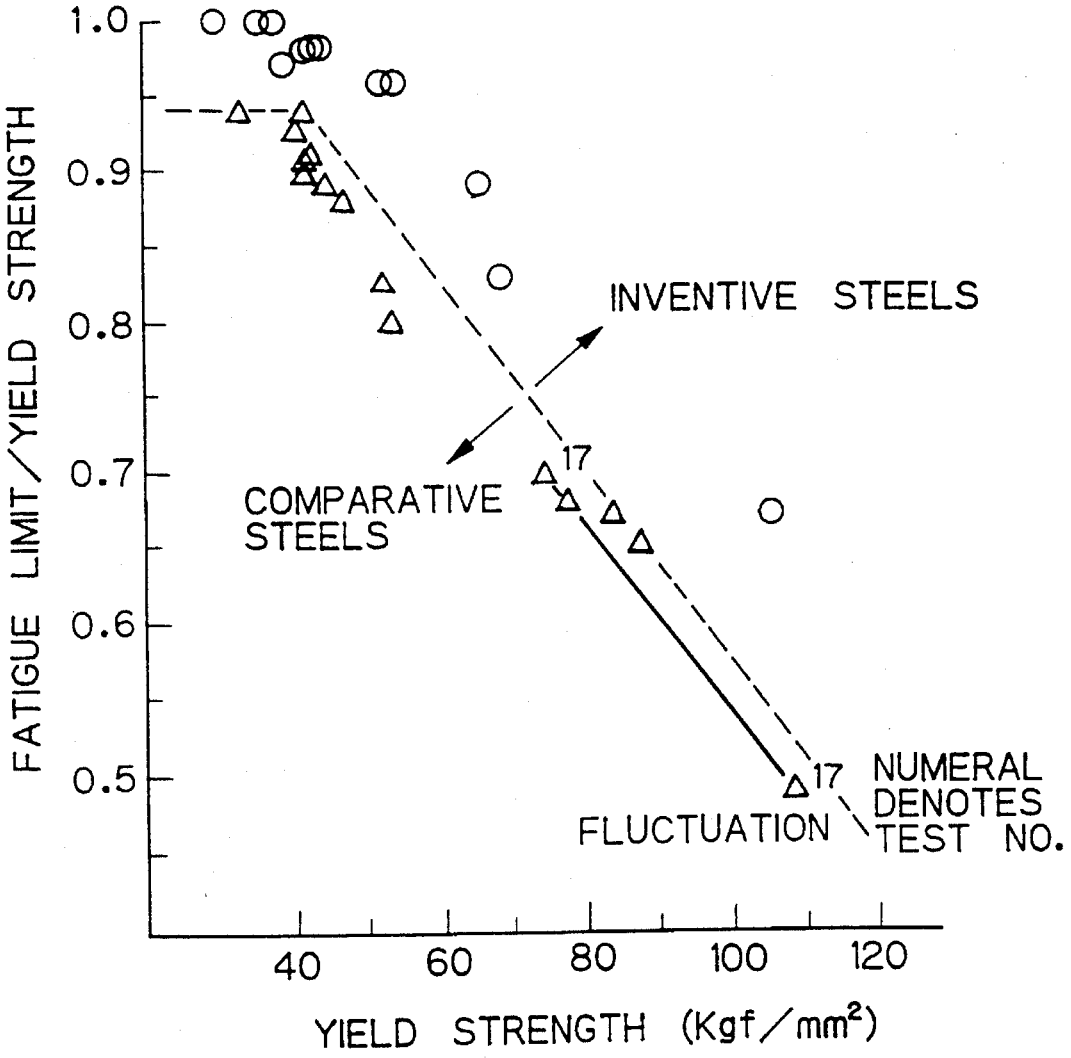
FIG. 4 is a graph showing the relationship between the yield strength and the ratio of fatigue limit to yield strength.

FIG. 4 shows the relationship between the yield strength and the ratio of fatigue limit to yield strength. The steels according to the present invention have an improved ratio of fatigue limit to yield strength with the yield strength level kept unchanged.

EXAMPLE 6

The steels having the chemical compositions shown in Table 13 were used to produce the inventive and comparative samples having the microstructures shown in Tables 26 to 30, which were then subjected to a fatigue test to yield the fatigue strength properties shown in Tables 26 to 30. Tensile and impact tests were carried out by using JIS No. 4 test pieces. The fatigue test was performed by using tensile specimens having a 10 mm diameter, 22 mm long parallel portion with the surface polished in the tensile direction. S-N diagrams were obtained under repeated loads with different intensities and a stress ratio of zero. The results were used to determine the fatigue limits which are summarized in Tables 26 to 30. The proportions of different phases in the steel microstructure were determined by measurement of the area percentage on a transmission electron micrograph of a steel plate sample.

Figure 5:
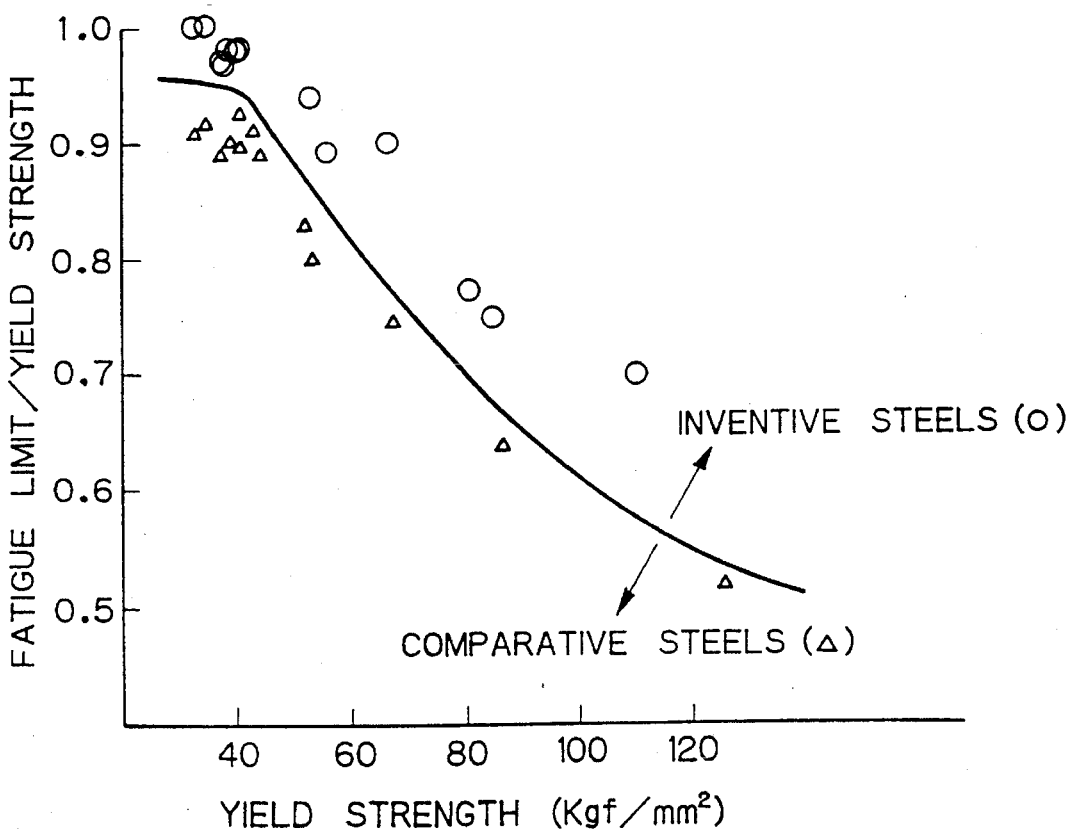
FIG. 5 is a graph showing the relationship between the yield strength and the ratio of fatigue limit to yield strength.

It is clear from Tables 26 to 30 that the present invention is advantageous in improving the fatigue strength. FIG. 5 shows the relationship between the yield strength and the ratio of fatigue limit to yield strength. The steels according to the present invention have a ratio of fatigue limit to yield strength so remarkably improved in comparison with that of the comparative steels, that the former are clearly distinguished from the latter. The curve in the drawing forms a boundary between the present inventive and comparative steels.

The present inventive steel has no substantial constructional limitation for avoiding stress concentration and therefore has wide application to structures subjected to a fluctuating load.

EXAMPLE 7

Figure 6:
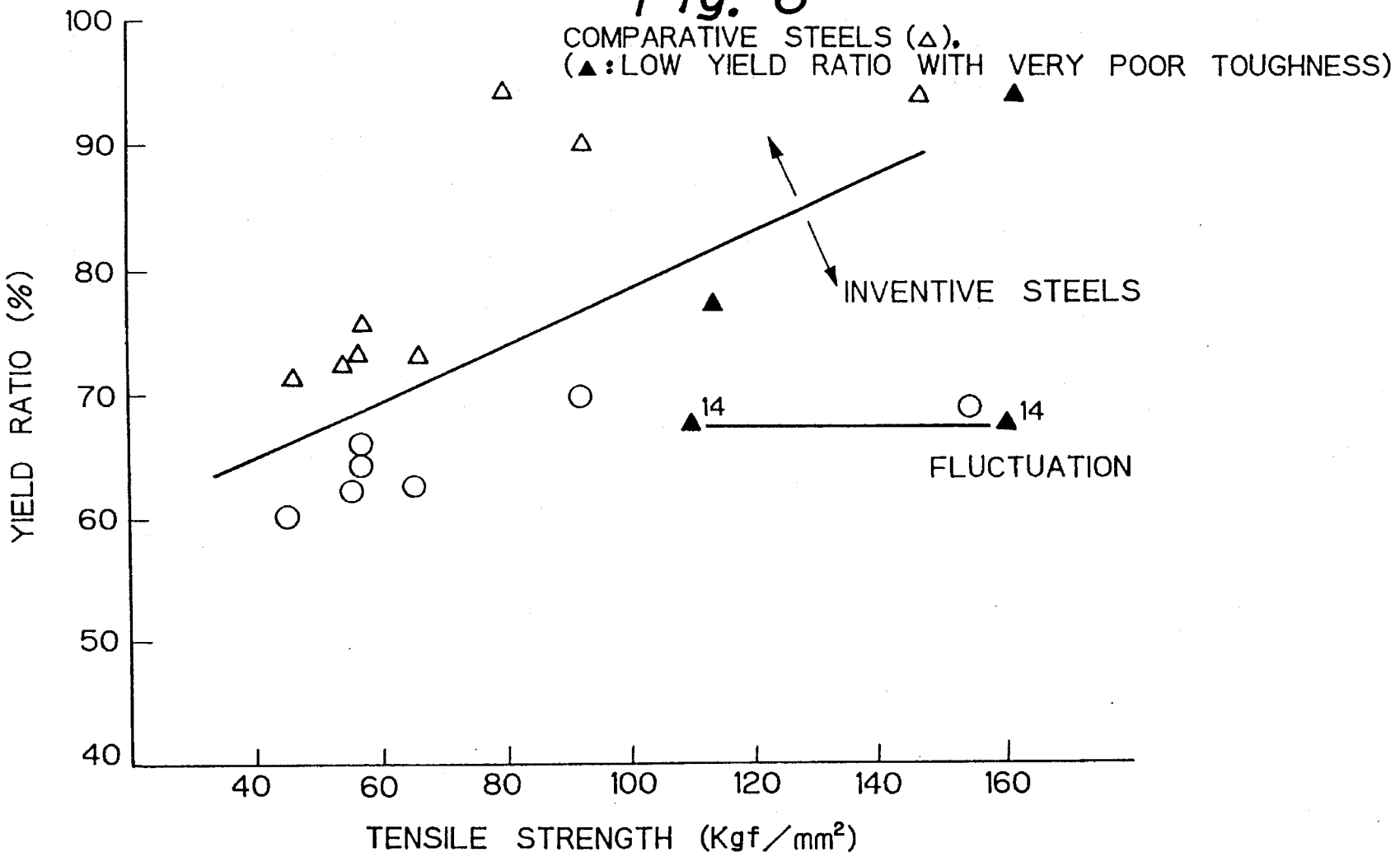
FIG. 6 is a graph showing the relationship between the tensile strength and the yield ratio.

The steels having the chemical compositions shown in Table 13 were used to produce the inventive and comparative samples having the microstructures shown in Tables 32 to 36, which were then subjected to a mechanical test to yield the tensile and impact properties shown in Tables 32 to 36. The tensile and impact tests were both carried out by using JIS No. 4 test pieces. The proportions of ferrite and cementite phases in the steel microstructure were determined by measurement of the area percentage on a transmission electron micrograph of a replica from a steel plate sample. The amount of retained austenite was determined by X-ray analysis (wide angle goniometric analysis). The results clearly show that the present invention is advantageous in lowering the yield ratio without the toughness being deteriorated. FIG. 6 shows the relationship between the tensile strength and the yield ratio. The steels according to the present invention have a reduced yield ratio with the tensile strength level kept unchanged.

TABLE 1

| | Chemical Composition of Steel (wt %) | | | | | | | | |
|---|---|---|---|---|---|---|---|---|---|
| Steel | C | Si | Mn | P | S | Cu | Ni | Cr | Mo |
| A | 0.16 | 0.2 | 1.4 | 0.005 | 0.003 | | | | |

TABLE 1-continued

| | Chemical Composition of Steel (wt %) | | | | | | | | |
|---|---|---|---|---|---|---|---|---|---|
| Steel | C | Si | Mn | P | S | Cu | Ni | Cr | Mo |
| B | 0.15 | 0.23 | 1.4 | 0.004 | 0.004 | | | | |
| C | 0.1 | 0.2 | 3 | 0.008 | 0.004 | | 1 | | |
| D | 0.14 | 0.25 | 1.5 | 0.005 | 0.003 | | | 0.2 | 0.2 |
| E | 0.08 | 0.25 | 1.6 | 0.01 | 0.005 | 0.5 | 1 | 0.5 | 0.5 |
| F | 0.1 | 0.22 | 1 | 0.004 | 0.003 | 0.4 | 3 | 1 | 0.5 |
| G | 0.1 | 0.18 | 1 | 0.006 | 0.004 | | 5 | 1 | 0.5 |
| H | 0.4 | 0.27 | 0.8 | 0.008 | 0.007 | | | 1 | 0.2 |

TABLE 2

| | Chemical Composition of Steel (wt %) | | | | | | | |
|---|---|---|---|---|---|---|---|---|
| Steel | Co | W | V | Nb | Ti | B | Al | N |
| A | | | | | | | 0.03 | 0.003 |
| B | | | | 0.02 | 0.01 | | 0.03 | 0.004 |
| C | 1 | 0.2 | | | | 0.001 | 0.04 | 0.002 |
| D | | | 0.03 | | 0.01 | | 0.03 | 0.003 |
| E | | | 0.04 | | 0.01 | 0.001 | 0.04 | 0.003 |
| F | | | | | | | 0.02 | 0.003 |
| G | | | | | | | 0.03 | 0.002 |
| H | | | | | | | 0.03 | 0.003 |

TABLE 3

| | | | Process Conditions | | | | |
|---|---|---|---|---|---|---|---|
| No. | Steel | Quench-Hardening Method | PT (mm) | HR (°C./sec) | T (°C.) | A (°C.) | t (min) |
| Iv | | | | | | | |
| 1 | A | RQ | 15 | 5 | 720 | 714 | 1 |
| 2 | B | RQ | 15 | 10 | 720 | 714 | 2 |
| 3 | C | RQ | 15 | 26 | 700 | 671 | 5 |
| 4 | D | RQ | 15 | 5 | 750 | 718 | 2 |
| 5 | D | DQ | 15 | 5 | 720 | 718 | 5 |
| 6 | E | DQ | 20 | 2 | 710 | 700 | 10 |
| 7 | E | DQ | 20 | 2 | 740 | 700 | 10 |
| 8 | F | RQ | 20 | 1.5 | 740 | 683 | 10 |
| 9 | F | DQ | 20 | 1.5 | 740 | 683 | 2 |
| 10 | G | RQ | 35 | 2 | 650 | 640 | 15 |
| 11 | G | DQ | 35 | 2 | 650 | 640 | 2 |
| 12 | H | DQ | 35 | 5 | 740 | 735 | 5 |
| 13 | H | DQ | 35 | 5 | 740 | 735 | 2 |
| Cp | | | | | | | |
| 14 | E | DQ | 20 | 0.1 | 720 | 703 | 10 |
| 15 | F | DQ | 20 | 0.2 | 700 | 683 | 30 |
| 16 | G | DQ | 35 | 2 | 580 | 649 | 20 |
| 17 | G | DQ | 35 | 2 | 690 | 649 | 60 |

(Note)
Iv: Invention, Cp: Comparison,
RQ: Reheat-Quench, DQ: Direct Quench,
PT: Plate Thickness, HR: Heating Rate,
T: Tempering Temperature,
t: Holding Time above $A_{c1}$.

TABLE 4

| | | Process Conditions and Mateiral Properties | | | | | |
|---|---|---|---|---|---|---|---|
| No. | Steel | Cooling Method | YS (kgf/mm$^2$) | TS (kgf/mm$^2$) | vTrs (°C.) | YR (%) | t (sec) |
| Iv | | | | | | | |

TABLE 4-continued

| Process Conditions and Mateiral Properties | | | | | | | |
|---|---|---|---|---|---|---|---|
| No. | Steel | Cooling Method | YS (kgf/mm²) | TS (kgf/mm²) | vTrs (°C.) | YR (%) | t (sec) |
| 1 | A | WC | 45 | 63 | −100 | 71 | 200 |
| 2 | B | AC | 50 | 68 | −130 | 73 | 200 |
| 3 | C | AC | 69 | 102 | −136 | 68 | 330 |
| 4 | D | AC | 47 | 69 | −60 | 68 | 270 |
| 5 | D | WC | 51 | 73 | −65 | 70 | 450 |
| 6 | E | AC | 71 | 98 | −75 | 72 | 900 |
| 7 | E | AC | 71 | 95 | −80 | 75 | 950 |
| 8 | F | AC | 70 | 103 | −130 | 68 | 750 |
| 9 | F | AC | 68 | 110 | −130 | 62 | 270 |
| 10 | G | WC | 61 | 90 | −140 | 68 | 1330 |
| 11 | G | AC | 64 | 98 | −135 | 65 | 550 |
| 12 | H | AC | 58 | 80 | −40 | 73 | 450 |
| 13 | H | AC | 62 | 82 | −35 | 75 | 270 |
| Cp | | | | | | | |
| 14 | E | AC | 78 | 86 | 10 | 91 | 7600 |
| 15 | F | AC | 86 | 91 | −50 | 95 | 5300 |
| 16 | G | AC | 84 | 90 | −85 | 93 | 1490 |
| 17 | G | WC | 73 | 79 | −40 | 92 | 3950 |

(Note)
Iv: Invention, Cp: Comparison,
WC: Water Cooling, AC: Air Cooling,
t: Time from Initiation of Heating to Initiation of Cooling.

TABLE 5

| Chemical Composition of Steel (wt %) | | | | | | | | | | |
|---|---|---|---|---|---|---|---|---|---|---|
| Steel | C | Si | Mn | P | S | V | Cu | Ni | Cr | Mo |
| A | 0.14 | 0.2 | 1.5 | 0.005 | 0.003 | 0.03 | 0.1 | 1 | 0.2 | 0.2 |
| B | 0.08 | 0.25 | 1.5 | 0.01 | 0.005 | 0.04 | 0.5 | 2 | 0.5 | 0.5 |
| C | 0.1 | 0.2 | 3 | 0.008 | 0.004 | 0 | 1 | 0 | 0 | 0 |
| D | 0.1 | 0.22 | 1 | 0.004 | 0.003 | 0 | 0.4 | 3 | 1 | 0.5 |
| E | 0.1 | 0.18 | 1 | 0.006 | 0.004 | 0 | 0 | 5 | 1 | 0.5 |
| F | 0.07 | 0.18 | 1 | 0.008 | 0.004 | 0 | 0.3 | 7.2 | 0.5 | 0.4 |
| G | 0.07 | 0.25 | 1 | 0.007 | 0.004 | 0 | 2.5 | 1 | 0.5 | 0.4 |
| H | 0.1 | 0.18 | 1 | 0.004 | 0.004 | 0 | 0.3 | 0 | 0 | 0.5 |
| I | 0.08 | 0.22 | 6.2 | 0.006 | 0.003 | 0 | 0 | 0 | 0 | 0.5 |
| J | 0.16 | 0.2 | 1.2 | 0.005 | 0.003 | 0 | 0 | 0 | 0.5 | 0.5 |
| K | 0.15 | 0.23 | 1.4 | 0.004 | 0.004 | 0 | 0 | 0 | 0.2 | 0.2 |

TABLE 6

| Chemical Composition of Steel (wt %) | | | | | | | | |
|---|---|---|---|---|---|---|---|---|
| Steel | Co | W | Nb | Ti | B | Al | N | M |
| A | 0 | 0 | 0.008 | 0.01 | 0 | 0.03 | 0.003 | 5.65 |
| B | 0 | 0 | 0 | 0.01 | 0.001 | 0.04 | 0.003 | 8.75 |
| C | 1 | 0.2 | 0 | 0 | 0.001 | 0.04 | 0.002 | 8 |
| D | 0 | 0 | 0 | 0 | 0 | 0.02 | 0.003 | 10.1 |
| E | 0 | 0 | 0 | 0 | 0 | 0.03 | 0.003 | 14.5 |
| F | 0 | 0 | 0.007 | 0.008 | 0 | 0.03 | 0.002 | 22.7 |
| G | 0 | 0 | 0 | 0 | 0 | 0.02 | 0.004 | 8.3 |
| H | 8.2 | 0 | 0 | 0.007 | 0.001 | 0.03 | 0.004 | 6.5 |
| I | 0 | 0 | 0.006 | 0.005 | 0.001 | 0.04 | 0.003 | 12 |
| J | 0 | 0 | 0.01 | 0 | 0.001 | 0 | 0.003 | 2.4 |
| K | 0 | 0 | 0 | 0.02 | 0.001 | 0 | 0.003 | 2.8 |

Note:
M = 2 Mn + 2.5 Ni + 1.5 Cu + 0.5 Co

TABLE 7

| Process Conditions | | | | | | | | |
|---|---|---|---|---|---|---|---|---|
| No. | Steel | QHM | PT (mm) | HR (°C./sec) | T (°C.) | $A_c$ (°C.) | t (min) | CLM |
| Iv | | | | | | | | |
| 1 | A | RQ | 15 | 1.5 | 695 | 690 | 0 | AC |
| 2 | A | DQ | 15 | 0.8 | 695 | 690 | 10 | AC |
| 3 | A | DQ | 15 | 0.8 | 695 | 690 | 20 | WC |
| 4 | B | RQ | 15 | 0.5 | 690 | 686 | 0 | AC |
| 5 | B | DQ | 15 | 0.5 | 690 | 686 | 10 | AC |
| 6 | B | DQ | 15 | 0.5 | 690 | 686 | 10 | WC |
| 7 | C | RQ | 20 | 0.3 | 690 | 682 | 10 | AC |
| 8 | C | DQ | 20 | 0.3 | 690 | 682 | 20 | AC |
| 9 | C | DQ | 20 | 5 | 720 | 682 | 0 | AC |
| 10 | C | DQ | 20 | 3 | 720 | 682 | 0 | WC |
| 11 | D | RQ | 35 | 0.7 | 685 | 683 | 10 | WC |
| 12 | D | DQ | 35 | 0.7 | 720 | 683 | 0 | AC |
| 13 | D | DQ | 35 | 0.7 | 710 | 683 | 0 | WC |
| 14 | E | DQ | 20 | 0.4 | 660 | 650 | 26 | AC |
| 15 | E | DQ | 20 | 0.4 | 660 | 650 | 8 | AC |
| 16 | E | DQ | 20 | 0.4 | 660 | 650 | 8 | WC |
| 17 | F | DQ | 50 | 0.3 | 630 | 602 | 10 | AC |
| 18 | F | DQ | 50 | 0.3 | 620 | 602 | 10 | WC |
| 19 | G | DQ | 20 | 2 | 700 | 694 | 0 | AC |
| 20 | G | DQ | 20 | 2 | 700 | 694 | 0 | WC |
| 21 | H | DQ | 35 | 0.3 | 705 | 695 | 5 | AC |
| 22 | H | DQ | 35 | 0.3 | 705 | 695 | 5 | WC |
| 23 | I | DQ | 20 | 5 | 663 | 663 | 3 | AC |
| 24 | I | DQ | 20 | 0.4 | 663 | 663 | 3 | WC |
| Cp | | | | | | | | |
| 25 | D | DQ | 35 | 0.2 | 750 | 750 | 60 | AC |
| 26 | B | DQ | 15 | 0.5 | 600 | 600 | 30 | AC |
| 27 | E | DQ | 20 | 0.3 | 780 | 780 | 20 | AC |
| 28 | J | DQ | 35 | 0.3 | 720 | 720 | 20 | AC |
| 29 | K | DQ | 35 | 0.3 | 725 | 725 | 20 | WC |

(Note)
Iv: Invention, Cp: Comparison,
QHM: Quench-Hardening Method,
RQ: Reheat-Quench, DQ: Direct Quench,
PT: Plate Thickness, HR: Heating Rate,
T: Tempering Temperature, t: Holding Time,
CLM: Cooling Method,
AC: Air Cooling, WC: Water Cooling.

TABLE 8

| Mechanical Properties | | | | | |
|---|---|---|---|---|---|
| No. | Steel | YS (kgf/mm²) | TS (kgf/mm²) | vTrs (°C.) | YR (%) |
| Iv | | | | | |
| 1 | A | 51 | 74 | −70 | 69 |
| 2 | A | 48 | 70 | −75 | 68 |
| 3 | A | 50 | 69 | −85 | 73 |
| 4 | B | 68 | 95 | −80 | 72 |
| 5 | B | 67 | 91 | −85 | 74 |
| 6 | B | 68 | 97 | −90 | 70 |
| 7 | C | 66 | 91 | −95 | 72 |
| 8 | C | 70 | 95 | −105 | 74 |
| 9 | C | 70 | 97 | −100 | 72 |
| 10 | C | 69 | 99 | −110 | 70 |
| 11 | D | 75 | 112 | −130 | 67 |
| 12 | D | 74 | 109 | −115 | 68 |
| 13 | D | 75 | 110 | −130 | 68 |
| 14 | E | 59 | 88 | −120 | 67 |
| 15 | E | 59 | 90 | −125 | 65 |
| 16 | E | 61 | 92 | −135 | 66 |
| 17 | F | 70 | 101 | <−196 | 69 |
| 18 | F | 73 | 103 | <−196 | 71 |
| 19 | G | 53 | 74 | −145 | 72 |
| 20 | G | 54 | 77 | −150 | 70 |

TABLE 8-continued

| | | Mechanical Properties | | | |
|---|---|---|---|---|---|
| No. | Steel | YS (kgf/mm²) | TS (kgf/mm²) | vTrs (°C.) | YR (%) |
| 21 | H | 69 | 90 | <–196 | 77 |
| 22 | H | 70 | 93 | <–196 | 75 |
| 23 | I | 56 | 77 | –140 | 73 |
| 24 | I | 55 | 76 | –160 | 72 |
| Cp | | | | | |
| 25 | D | 71 | 75 | –20 | 94 |
| 26 | B | 82 | 89 | –85 | 92 |
| 27 | E | 65 | 70 | –30 | 93 |
| 28 | J | 47 | 52 | +20 | 90 |
| 29 | K | 50 | 57 | +20 | 88 |

(Note)
Iv: Invention, Cp: Comparison.

TABLE 9

| | Chemical Composition of Steel (wt %) | | | | | | | | |
|---|---|---|---|---|---|---|---|---|---|
| Steel | C | Si | Mn | P | S | V | Cu | Ni | Cr |
| A | 0.12 | 0.2 | 1.4 | 0.005 | 0.003 | 0.03 | 0 | 1 | 0.2 |
| B | 0.1 | 0.2 | 1 | 0.008 | 0.004 | 0 | 0.5 | 2 | 0 |
| C | 0.08 | 0.21 | 3 | 0.01 | 0.005 | 0.03 | 0.5 | 0 | 0.5 |
| D | 0.1 | 0.22 | 1 | 0.004 | 0.003 | 0 | 0 | 3 | 1 |
| E | 0.1 | 0.18 | 1 | 0.006 | 0.004 | 0 | 0 | 5 | 1 |
| F | 0.09 | 0.2 | 1.4 | 0.005 | 0.003 | 0 | 0.4 | 8 | 0 |
| G | 0.07 | 0.2 | 1.2 | 0.007 | 0.004 | 0.02 | 2.5 | 1 | 0.5 |
| H | 0.1 | 0.2 | 1.2 | 0.006 | 0.003 | 0 | 0.3 | 0 | 0.5 |
| I | 0.08 | 0.22 | 6.2 | 0.006 | 0.004 | 0 | 0.2 | 0 | 0.5 |
| J | 0.15 | 0.23 | 1.4 | 0.004 | 0.004 | 0.03 | 0 | 0 | 0 |

TABLE 10

| | Chemical Composition of Steel (wt %) | | | | | | | | |
|---|---|---|---|---|---|---|---|---|---|
| Steel | Mo | Co | W | Nb | Ti | B | Al | N | M |
| A | 0.2 | 1 | 0 | 0.007 | 0 | 0.001 | 0.04 | 0.003 | 6 |
| B | 0 | 0.5 | 0.2 | 0 | 0.01 | 0 | 0.04 | 0.002 | 8 |
| C | 0.5 | 1 | 0 | 0 | 0 | 0 | 0.04 | 0.005 | 6.75 |
| D | 0.5 | 0 | 0 | 0 | 0 | 0 | 0.02 | 0.003 | 9.5 |
| E | 0.5 | 0 | 0 | 0 | 0 | 0 | 0.03 | 0.002 | 14.5 |
| F | 0.4 | 0 | 0 | 0 | 0 | 0 | 0.03 | 0.003 | 23.4 |
| G | 0.5 | 0 | 0 | 0.006 | 0.008 | 0 | 0.04 | 0.005 | 8.65 |
| H | 0 | 6.5 | 0 | 0 | 0 | 0 | 0.04 | 0.003 | 6.1 |
| I | 0.4 | 0 | 0 | 0 | 0 | 0 | 0.05 | 0.005 | 12.7 |
| J | 0.5 | 0 | 0 | 0.02 | 0.01 | 0.001 | 0.03 | 0.004 | 2.8 |

Note:
M = 2 Mn + 2.5 Ni + 1.5 Cu + 0.5 Co

TABLE 11

| | | | Process Conditions | | | | | |
|---|---|---|---|---|---|---|---|---|
| No. | Steel | QHM | PT (mm) | HR (°C./sec) | T (°C.) | $A_c$ (°C.) | t (min) | CLM |
| Iv | | | | | | | | |
| 1 | A | RQ | 15 | 2 | 660 | 689 | 0 | WC |
| 2 | B | RQ | 15 | 10 | 640 | 678 | 12 | AC |
| 3 | C | RQ | 20 | 5 | 690 | 703 | 0 | WC |

TABLE 11-continued

| | | | Process Conditions | | | | | |
|---|---|---|---|---|---|---|---|---|
| No. | Steel | QHM | PT (mm) | HR (°C./sec) | T (°C.) | $A_c$ (°C.) | t (min) | CLM |
| 4 | C | DQ | 20 | 5 | 690 | 703 | 10 | AC |
| 5 | D | DQ | 35 | 5 | 700 | 685 | 0 | AC |
| 6 | D | DQ | 35 | 5 | 700 | 685 | 0 | WC |
| 7 | E | RQ | 20 | 10 | 600 | 650 | 25 | AC |
| 8 | E | DQ | 20 | 1.5 | 630 | 650 | 0 | AC |
| 9 | E | DQ | 20 | 1.5 | 630 | 650 | 0 | WC |
| 10 | F | DQ | 35 | 0.3 | 570 | 576 | 20 | AC |
| 11 | F | DQ | 35 | 0.3 | 590 | 576 | 20 | WC |
| 12 | G | DQ | 50 | 3 | 690 | 690 | 12 | AC |
| 13 | G | DQ | 50 | 3 | 690 | 690 | 12 | WC |
| 14 | H | DQ | 35 | 0.7 | 710 | 706 | 0 | AC |
| 15 | H | DQ | 35 | 0.7 | 710 | 706 | 0 | WC |
| 16 | I | DQ | 20 | 2 | 650 | 672 | 5 | AC |
| 17 | I | DQ | 20 | 2 | 650 | 672 | 5 | WC |
| Cp | | | | | | | | |
| 18 | D | DQ | 35 | 2.5 | 780 | 685 | 20 | AC |
| 19 | E | DQ | 20 | 0.1 | 600 | 650 | 25 | AC |
| 20 | E | DQ | 20 | 2.5 | 600 | 650 | 60 | AC |
| 21 | J | DQ | 35 | 1 | 700 | 715 | 20 | WC |

(Note)
Iv: Invention, Cp: Comparison,
QHM: Quench-Hardening Method,
RQ: Reheat-Quench, DQ: Direct Quench,
PT: Plate Thickness, HR: Heating Rate,
T: Tempering Temperature, t: Holding Time,
CLM: Cooling Method,
AC: Air Cooling, WC: Water Cooling.

TABLE 12

| | | Mechanical Properties | | | | |
|---|---|---|---|---|---|---|
| No. | Steel | YS (kgf/mm²) | TS (kgf/mm²) | vTrs (°C.) | YR (%) | t (sec) |
| Iv | | | | | | |
| 1 | A | 52 | 70 | –65 | 74 | 320 |
| 2 | B | 57 | 86 | –115 | 66 | 130 |
| 3 | C | 71 | 102 | –75 | 70 | 150 |
| 4 | C | 71 | 98 | –85 | 72 | 740 |
| 5 | D | 67 | 94 | –140 | 71 | 140 |
| 6 | D | 68 | 96 | –150 | 71 | 140 |
| 7 | E | 66 | 90 | –130 | 73 | 1600 |
| 8 | E | 59 | 94 | –140 | 62 | 410 |
| 9 | E | 61 | 95 | –155 | 64 | 410 |
| 10 | F | 71 | 108 | <–196 | 68 | 1600 |
| 11 | F | 69 | 107 | <–196 | 64 | 1600 |
| 12 | G | 56 | 180 | –130 | 70 | 950 |
| 13 | G | 58 | 182 | –145 | 71 | 950 |
| 14 | H | 68 | 92 | <–196 | 74 | 1000 |
| 15 | H | 68 | 95 | <–196 | 72 | 1000 |
| 16 | I | 55 | 80 | –135 | 69 | 610 |
| 17 | I | 57 | 182 | –150 | 70 | 610 |
| Cp | | | | | | |
| 18 | D | 75 | 80 | 20 | 94 | 2100 |
| 19 | E | 77 | 86 | –85 | 89 | 4100 |
| 20 | E | 83 | 88 | –80 | 94 | 3850 |
| 21 | J | 52 | 57 | –40 | 92 | 1880 |

(Note)
t: Time from Initiation of Heating to Initiation of Cooling during Tempering

TABLE 13

| Steel | C | Si | Mn | Cu | Ni | Cr | Mo | Co | W | Nb | Ti | V | B | Al | Rem | Ca |
|---|---|---|---|---|---|---|---|---|---|---|---|---|---|---|---|---|
| | (wt %) | | | | | | | | | | | | | | | |
| A | 0.08 | 0.24 | 1.33 | 0.12 | 0.40 | — | — | — | — | 0.005 | 0.007 | 0.004 | — | 0.025 | — | 0.0020 |
| B | 0.15 | 0.18 | 1.10 | — | — | — | — | — | — | — | 0.007 | 0.004 | — | 0.030 | 0.01 | — |
| C | 0.05 | 0.26 | 1.55 | — | — | — | — | — | — | 0.045 | 0.022 | — | 0.0011 | 0.030 | — | 0.0030 |
| D | 0.04 | 0.29 | 0.72 | 0.41 | 0.14 | 0.55 | — | — | — | 0.020 | — | — | — | 0.025 | — | — |
| E | 0.22 | 0.06 | 0.33 | — | — | — | — | — | — | — | — | — | — | 0.007 | — | — |
| F | 0.10 | 0.20 | 1.00 | 0.61 | 0.89 | 0.30 | 0.30 | — | — | — | — | 0.046 | 0.0009 | 0.069 | — | 0.0022 |
| G | 0.11 | 0.16 | 0.30 | — | 9.9 | 5.8 | 0.90 | 8.8 | 0.1 | — | — | — | — | 0.005 | — | — |
| H | 0.05 | 1.05 | 0.30 | 1.33 | 1.72 | 0.40 | 0.50 | — | — | 0.025 | 0.009 | — | 0.0008 | 0.077 | — | — |
| I | 0.07 | 0.26 | 1.72 | — | — | — | — | — | — | — | 0.018 | — | — | 0.025 | — | — |
| J | 0.08 | 0.25 | 1.71 | — | — | — | — | — | — | 0.014 | — | — | — | 0.027 | — | — |
| K | 0.12 | 0.26 | 1.31 | — | — | — | — | — | — | — | — | 0.042 | — | 0.018 | — | — |
| L | 0.11 | 0.28 | 1.21 | — | — | — | — | — | — | — | — | — | 0.0011 | 0.027 | 0.05 | — |
| M | 0.12 | 0.33 | 1.06 | — | — | 0.45 | — | — | — | — | 0.011 | — | — | 0.035 | — | — |

TABLE 14

| No. | Steel | Phase proportion (%) F | C | M(q) | A(r) | Condition of coexisting ferrite and cementite | Mechanical properties TS (kgf/mm²) | YS (kgf/mm²) | YR (%) | FATT (°C.) | FL (kgf/mm²) | FL/YS | Remarks |
|---|---|---|---|---|---|---|---|---|---|---|---|---|---|
| 1 | H | 80 | 16 | 4 | 0 | M(t)[F(l) + C(b)] | 96.3 | 64.0 | 67 | −158 | 57 | 0.89 | Invention |
| 2 | H | 95.4 | 4 | 0.6 | 0 | M(t)[F(l) + C(l)] | 111 | 83 | 74.8 | −160 | 60 | 0.75 | Invention |
| 3 | H | 78.9 | 18 | 2.6 | 0.5 | " | 93.5 | 65.5 | 70 | −170 | 59 | 0.90 | Invention |
| 4 | H | 87.2 | 12 | 0 | 0.8 | " | 80.5 | 75.7 | 94 | −165 | 50 | 0.66 | Comparison |
| 5 | H | 0 | 0 | 100 | 0 | M(q)[no C] | 114 | 87.4 | 76.7 | −60 | 48 | 0.55 | Comparison |
| 6 | H | 79.2 | 14 | 6.5 | 0.3 | M(t)[F(l) + C] | 99.3 | 62.1 | 62.5 | −80 | 43 | 0.69 | Comparison |

(Note) F: ferrite, F(l): lath ferrite, C: cementite, C(b): inter-lath cementite layer, C(l): in-lath cementite, M(q): as-quenched martensite, M(t): tempered martensite, B: bainite, A(r): retained austenite, TS: tensile strength, YS: yield strength, YR: yield ratio, FATT: fracture appearance transition temperature, FL: fatigue limit.

TABLE 15

| No. | Steel | Phase proportion (%) F | C | M(q) | A(r) | Condition of coexisting ferrite and cementite | Mechanical properties TS (kgf/mm²) | YS (kgf/mm²) | YR (%) | FATT (°C.) | FL (kgf/mm²) | FL/YS | Remarks |
|---|---|---|---|---|---|---|---|---|---|---|---|---|---|
| 7 | E | 62 | 38(P) | 0 | 0 | F + P | 47 | 33 | 70.2 | +10 | 29 | 0.88 | Comparison |
| 8 | E | 62 | 36(P) | 2 | 0 | " | 49 | 30 | 61.2 | −22 | 30 | 1.00 | Invention |
| 9 | F | 89 | 8 | 3 | 0 | M(t)[F(l) + C(b)] | 94 | 65.8 | 70.0 | −122 | 61 | 0.93 | Invention |
| 10 | F | 88 | 6 | 6 | 0 | " | 99 | 63 | 63.6 | −81 | 48 | 0.76 | Comparison |
| 11 | G | 90 | 8(P) | 2 | 0 | F + P | 66 | 41 | 62.1 | −116 | 40 | 0.98 | Invention |
| 12 | G | 89 | 11(P) | 0 | 0 | " | 62 | 44.6 | 72.0 | −110 | 40 | 0.90 | Comparison |

(Note) F: ferrite, F(l): lath ferrite, C: cementite, C(b): inter-lath cementite layer, C(l): in-lath cementite, P: pearlite, M(q): as-quenched martensite, M(t): tempered martensite, B: bainite, A(r): retained austenite, TS: tensile strength, YS: yield strength, YR: yield ratio, FATT: fracture appearance transition temperature, FL: fatigue limit.

TABLE 16

| No. | Steel | Phase proportion (%) F | C | M(q) | A(r) | Condition of coexisting ferrite and cementite | Mechanical properties TS (kgf/mm²) | YS (kgf/mm²) | YR (%) | FATT (°C.) | FL (kgf/mm²) | FL/YS | Remarks |
|---|---|---|---|---|---|---|---|---|---|---|---|---|---|
| 13 | A | 78.0 | 18.7 (B) | 3.3 | 0 | F + B | 56 | 34.7 | 62.0 | −101 | 34 | 0.98 | Invention |
| 14 | A | 80.0 | 20.0 (B) | 0 | 0 | " | 53 | 39 | 73.5 | −96 | 33 | 0.85 | Comparison |
| 15 | B | 62.1 | 36 (P + B) | 1.9 | 0 | F + P + B | 57 | 37.6 | 66.0 | −105 | 36 | 0.96 | Invention |
| 16 | B | 63.5 | 29.5 (P + B) | 7 | 0 | " | 61 | 36.5 | 59.8 | -46 | 32 | 0.91 | Comparison |
| 17 | D | 91 | 6.8 | 2.2 | 0 | F + P | 57 | 37.1 | 65.0 | -71 | 37 | 1.00 | Invention |

TABLE 16-continued

| No. | Steel | Phase proportion (%) F | C | M(q) | A(r) | Condition of coexisting ferrite and cementite | Mechanical properties TS (kgf/mm²) | YS (kgf/mm²) | YR (%) | FATT (°C.) | FL (kgf/mm²) | FL/YS | Remarks |
|---|---|---|---|---|---|---|---|---|---|---|---|---|---|
| 18 | D | 90 | (P) 10.0 (P) | 0 | 0 | " | 54 | 40.1 | 74.3 | -70 | 36 | 0.90 | Comparison |

(Note) F: ferrite, F(l): lath ferrite, C: cementite, C(b): inter-lath cementite layer, C(l): in-lath cementite, P: pearlite, M(q): as-quenched martensite, M(t): tempered martensite, B: bainite, A(r): retained austenite, TS: tensile strength, YS: yield strength, YR: yield ratio, FATT: fracture appearance transition temperature, FL: fatigue limit.

TABLE 17

| No. | Steel | Phase proportion (%) F | C | M(q) | A(r) | Condition of coexisting ferrite and cementite | Mechanical properties TS (kgf/mm²) | YS (kgf/mm²) | YR (%) | FATT (°C.) | FL (kgf/mm²) | FL/YS | Remarks |
|---|---|---|---|---|---|---|---|---|---|---|---|---|---|
| 19 | G | 86 | 8.7 | 4.5 | 0.8 | M(t)[F(l) + C(b)] | 156 | 106 | 68.0 | −54 | 62 | 0.58 | Invention |
| 20 | G | 90.6 | 6.8 | 2.1 | 0.5 | M(t)[F(l) + C(l)] | 150 | 107 | 71.3 | −55 | 61 | 0.57 | " |
| 21 | G | 90 | 9.5 | 0 | 0.5 | " | 144 | 126.7 | 88.0 | −61 | 58 | 0.46 | Comparison |
| 22 | I | 84 | 12(P) | 3.5 | 0.5 | F + P | 68 | 41 | 61 | −96 | 40 | 0.98 | Invention |
| 23 | I | 85 | 15(P) | 0 | 0 | " | 61 | 44 | 72 | −96 | 39 | 0.89 | Comparison |
| 24 | J | 87 | 10(P) | 3.0 | 0 | " | 66 | 38 | 58 | −78 | 38 | 1.00 | Invention |
| 25 | J | 85 | 15(P) | 0 | 0 | " | 64 | 45 | 70 | −66 | 37 | 0.82 | Comparison |

(Note) F: ferrite, F(l): lath ferrite, C: cementite, C(b): inter-lath cementite layer, C(l): in-lath cementite, P: pearlite, M(q): as-quenched martensite, M(t); tempered martensite, B: bainite, A(r): retained austenite, TS: tensile strength, YS: yield strength, YR: yield ratio, FATT: fracture appearance transition temperature, FL: fatigue limit.

TABLE 18

| No. | Steel | Phase proportion (%) F | C | M(q) | A(r) | Condition of coexisting ferrite and cementite | Mechanical properties TS (kgf/mm²) | YS (kgf/mm²) | YR (%) | FATT (°C.) | FL (kgf/mm²) | FL/YS | Remarks |
|---|---|---|---|---|---|---|---|---|---|---|---|---|---|
| 26 | K | 73 | 22(p) | 4.5 | 0.5 | F + P | 63 | 37 | 59 | −70 | 36 | 0.97 | Invention |
| 27 | K | 71 | 29(P) | 0 | 0 | " | 57 | 43 | 75 | −62 | 35 | 0.81 | Comparison |
| 28 | L | 90 | 7 | 3 | 0 | M(t)[F(l) + C(b)] | 67 | 44 | 66 | −100 | 42 | 0.95 | Invention |
| 29 | L | 89 | 11 | 0 | 0 | M(t)[F(l) + C(l)] | 55 | 50 | 91 | −90 | 40 | 0.80 | Comparison |
| 30 | M | 89 | 7 | 4 | 0 | M(t)[F(l) + C(b)] | 74 | 50 | 68 | −96 | 47 | 0.94 | Invention |
| 31 | M | 90 | 9.5 | 0 | 0.5 | M(t)[F(l) + C(l)] | 60 | 53 | 88 | −85 | 43 | 0.85 | Comparison |

(Note) F: ferrite, F(l): lath ferrite, C: cementite, C(b): inter-lath cementite layer, C(l): in-lath cementite, P: pearlite, M(q): as-quenched martensite, M(t): tempered martensite, B: bainite, A(r): retained austenite, TS: tensile strength, YS: yield strength, YR: yield ratio, FATT: fracture appearance transition temperature, FL: fatigue limit.

TABLE 20

| No. | Steel | Phase proportion (%) F | C | M(q) | A(r) | Condition of coexisting ferrite and cementite | Mechanical properties TS (kgf/mm²) | YS (kgf/mm²) | YR (%) | FATT (°C.) | FL (kgf/mm²) | FL/YS | Remarks |
|---|---|---|---|---|---|---|---|---|---|---|---|---|---|
| 1 | D | 90 | 7(p) | 0 | 3 | F + P | 58 | 38 | 65.5 | −71 | 38 | 1.00 | Invention |
| 2 | D | 89 | 10.5(P) | 0 | 0.5 | " | 57 | 42 | 73.7 | −52 | 39.5 | 0.94 | Comparison |
| 3 | E | 62 | 28(p) | 0 | 10 | F + P | 46 | 30 | 65.2 | −24 | 30 | 1.00 | Invention |
| 4 | E | 63 | 37(p) | 0 | 0 | " | 47 | 34 | 72.3 | +10 | 32 | 0.94 | Comparison |
| 5 | F | 86 | 9 | 0 | 5 | M(t)[F(l) + C(b)] | 93 | 66 | 71.0 | −121 | 59 | 0.89 | Invention |
| 6 | F | 88 | 11.5 | 0 | 0.5 | M(t)[F(l) + C(l)] | 94 | 84 | 89.4 | −98 | 56 | 0.67 | Comparison |

(Note) F: ferrite, F(l): lath ferrite, C: cementite, C(b): inter-lath cementite layer, C(l): in-lath cementite, P: pearlite, M(q): as-quenched martensite, M(t): tempered martensite, B: bainite, A(r): retained austenite, TS: tensile strength, YS: yield strength, YR: yield ratio, FATT: fracture appearance transition temperature, FL: fatigue limit.

TABLE 21

| No. | Steel | Phase proportion (%) F | C | M(q) | A(r) | Condition of coexisting ferrite and cementite | Mechanical properties TS (kgf/mm²) | YS (kgf/mm²) | YR (%) | FATT (°C.) | FL (kgf/mm²) | FL/YS | Remarks |
|---|---|---|---|---|---|---|---|---|---|---|---|---|---|
| 7 | A | 76 | 17.9(B) | 0 | 6.1 | F + P | 57 | 36 | 63.2 | −101 | 36 | 1.00 | Invention |
| 8 | A | 75 | 25(B) | 0 | 0 | " | 55 | 41 | 74.5 | −91 | 38 | 0.93 | Comparison |
| 9 | B | 62 | 35(P + B) | 0 | 3.0 | F + P | 58 | 39 | 67.2 | −101 | 38 | 0.97 | Invention |
| 10 | B | 65 | 35(P + B) | 0 | 0 | " | 58 | 43 | 74.1 | −90 | 39 | 0.91 | Comparison |
| 11 | C | 90 | 8(P) | 0 | 2 | M(t)[F(l) + C(b)] | 66 | 42 | 63.6 | −110 | 41 | 0.98 | Invention |
| 12 | C | 88 | 12(P) | 0 | 0 | M(t)[F(l) + C(l)] | 66 | 48 | 72.7 | −83 | 42 | 0.88 | Comparison |

(Note) F: ferrite, F(l): lath ferrite, C: cementite, C(b): inter-lath cementite layer, C(l): in-lath cementite, P: pearlite, M(q): as-quenched martensite, M(t): tempered martensite, B: bainite, A(r): retained austenite, TS: tensile strength, YS: yield strength, YR: yield ratio, FATT: fracture appearance transition temperature, FL: fatigue limit.

TABLE 22

| No. | Steel | Phase proportion (%) F | C | M(q) | A(r) | Condition of coexisting ferrite and cementite | Mechanical properties TS (kgf/mm²) | YS (kgf/mm²) | YR (%) | FATT (°C.) | FL (kgf/mm²) | FL/YS | Remarks |
|---|---|---|---|---|---|---|---|---|---|---|---|---|---|
| 13 | H | 0 | 0 | 100 | 0 | M(q) | 113 | 87.5 | 77 | −56 | 57.0 | 0.65 | Comparison |
| 14 | H | 87 | 12.5 | 0 | 0.5 | M(t)[F(l) + C(l)] | 80 | 78 | 98 | −152 | 53 | 0.68 | Comparison |
| 15 | H | 80 | 14 | 0 | 6 | M(t)[F(l) + C(b)] | 94 | 69 | 73 | −170 | 57 | 0.83 | Invention |
| 16 | G | 86 | 8.5 | 0 | 5.5 | M(t)[F(l) + C(b)] | 150 | 106 | 70.7 | −62 | 71 | 0.67 | Invention |
| 17 | G | 63 | 0 | 5 | 32 | M(t) | *110/160 | *75/109 | 68.1/68.1 | −30 | 53 | 0.70/0.49 | Comparison |

(Note) F: ferrite, F(l): lath ferrite, C: cementite, C(b): inter-lath cementite layer, C(l): in-lath cementite, P: pearlite, M(q): as-quenched martensite, M(t): tempered martensite, B: bainite, A(r): retained austenite, TS: tensile strength, YS: yield strength, YR: yield ratio, FATT: fracture appearance transition temperature, FL: fatigue limit.
*: fluctuation.

TABLE 23

| No. | Steel | Phase proportion (%) F | C | M(q) | A(r) | Condition of coexisting ferrite and cementite | Mechanical properties TS (kgf/mm²) | YS (kgf/mm²) | YR (%) | FATT (°C.) | FL (kgf/mm²) | FL/YS | Remarks |
|---|---|---|---|---|---|---|---|---|---|---|---|---|---|
| 18 | I | 86 | 11.5(P) | 0 | 2.5 | F + P | 69 | 42 | 61 | −117 | 41 | 0.98 | Invention |
| 19 | I | 85 | 15(P) | 0 | 0 | F + P | 62 | 43 | 69 | −105 | 39 | 0.91 | Comparison |
| 20 | J | 88 | 7(P) | 0 | 5 | F + P | 67 | 43 | 64 | −78 | 42 | 0.98 | Invention |
| 21 | J | 87 | 13(P) | 0 | 0 | F + P | 63 | 45 | 71 | −62 | 40 | 0.89 | Comparison |
| 22 | K | 75 | 22(P) | 0 | 3 | F + P | 66 | 41 | 62 | −71 | 40 | 0.98 | Invention |
| 23 | K | 74 | 26(P) | 0 | 0 | F + P | 60 | 42 | 70 | −62 | 38 | 0.90 | Comparison |

(Note) F: ferrite, F(l): lath ferrite, C: cementite, C(b): inter-lath cementite layer, C(l): in-lath cementite, P: pearlite, M(q): as-quenched martensite, M(t): tempered martensite, B: bainite, A(r): retained austenite, TS: tensile strength, YS: yield strength, YR: yield ratio, FATT: fracture appearance transition temperature, FL: fatigue limit.

TABLE 24

| No. | Steel | Phase proportion (%) F | C | M(q) | A(r) | Condition of coexisting ferrite and cementite | Mechanical properties TS (kgf/mm²) | YS (kgf/mm²) | YR (%) | FATT (°C.) | FL (kgf/mm²) | FL/YS | Remarks |
|---|---|---|---|---|---|---|---|---|---|---|---|---|---|
| 24 | L | 92 | 4.5 | 0 | 3.5 | M(t)[F(l) + C(b)] | 68 | 52 | 76.0 | −102 | 50 | 0.96 | Invention |
| 25 | L | 92 | 8 | 0 | 0 | M(t) + C(l) | 60 | 53 | 88.0 | −90 | 44 | 0.83 | Comparison |
| 26 | M | 90 | 6.7 | 0 | 3.3 | M(t)[F(l) + C(b)] | 72 | 53 | 74.0 | −106 | 51 | 0.96 | Invention |
| 27 | M | 90 | 10 | 0 | 0 | M(t)[F(l) + C(l)] | 60 | 54 | 90.0 | −91 | 44 | 0.80 | Comparison |

(Note) F: ferrite, F(l): lath ferrite, C: cementite, C(b): inter-lath cementite layer, C(l): in-lath cementite, P: pearlite, M(q): as-quenched martensite, M(t): tempered martensite, B: bainite, A(r): retained austenite, TS: tensile strength, YS: yield strength, YR: yield ratio, FATT: fracture appearance transition temperature, FL: fatigue limit,

TABLE 26

| No. | Steel | Phase proportion (%) F | C | M(q) | A(r) | Condition of coexisting ferrite and cementite | Mechanical properties TS (kgf/mm²) | YS (kgf/mm²) | YR (%) | FATT (°C.) | FL (kgf/mm²) | FL/YS | Remarks |
|---|---|---|---|---|---|---|---|---|---|---|---|---|---|
| 1 | A | 77 | 18.5(B) | 4.5 | 0 | F + B | 57 | 35 | 61.4 | −104 | 35 | 1.00 | Invention |
| 2 | A | 79 | 21(B) | 0 | 0 | " | 53 | 38 | 71.6 | −90 | 34 | 0.89 | Comparison |
| 3 | B | 63 | 35(P + B) | 2 | 0 | F + P + B | 58 | 38 | 65.5 | −101 | 37 | 0.97 | Invention |
| 4 | B | 65 | 28(P + B) | 7 | 0 | " | 60 | 36 | 60.0 | −60 | 33 | 0.92 | Comparison |
| 5 | C | 89 | 9(P) | 2 | 0 | F + P | 66 | 42 | 63.6 | −115 | 41 | 0.98 | Invention |
| 6 | C | 88 | 12(P) | 0 | 0 | " | 61 | 44 | 72.1 | −105 | 40 | 0.91 | Comparison |

(Note) F: ferrite, F(l): lath ferrite, C: cementite, C(b): inter-lath cementite layer, C(l): in-lath cementite, P: pearlite, M(q): as-quenched martensite, M(t): tempered martensite, B: bainite, A(r): retained austenite, TS: tensile strength, YS: yield strength, YR: yield ratio, FATT: fracture appearance transition temperature, FL: fatigue limit.

TABLE 27

| No. | Steel | Phase proportion (%) F | C | M(q) | A(r) | Condition of coexisting ferrite and cementite | Mechanical properties TS (kgf/mm²) | YS (kgf/mm²) | YR (%) | FATT (°C.) | FL (kgf/mm²) | FL/YS | Remarks |
|---|---|---|---|---|---|---|---|---|---|---|---|---|---|
| 7 | D | 90 | 7(P) | 3 | 0 | F + P | 58 | 38 | 66.0 | −73 | 37 | 0.97 | Invention |
| 8 | D | 91 | 9(P) | 0 | 0 | " | 54 | 40 | 74.0 | −69 | 36 | 0.90 | Comparison |
| 9 | E | 63 | 34 | 3 | 0 | F + P | 50 | 33 | 66.0 | −25 | 33 | 1.00 | Invention |
| 10 | E | 64 | 36 | 0 | 0 | " | 46 | 34 | 73.9 | +15 | 31 | 0.91 | Comparison |
| 11 | F | 90 | 6 | 4 | 0 | M(t)[F(l) + C(b)] | 95 | 67 | 70.5 | −125 | 60 | 0.90 | Invention |
| 12 | F | 89 | 5 | 6 | 0 | " | 99 | 64 | 64.6 | −85 | 48 | 0.75 | Comparison |

(Note) F: ferrite, F(l): lath ferrite, C: cementite, C(b): inter-lath cementite layer, C(l): in-lath cementite, P: pearlite, M(q): as-quenched martensite, M(t): tempered martensite, B: bainite, A(r): retained austenite, TS: tensile strength, YS: yield strength, YR: yield ratio, FATT: fracture appearance transition temperature, FL: fatigue limit.

TABLE 28

| No. | Steel | Phase proportion (%) F | C | M(q) | A(r) | Condition of coexisting ferrite and cementite | Mechanical properties TS (kgf/mm²) | YS (kgf/mm²) | YR (%) | FATT (°C.) | FL (kgf/mm²) | FL/YS | Remarks |
|---|---|---|---|---|---|---|---|---|---|---|---|---|---|
| 13 | G | 91 | 6 | 2.5 | 0.5 | M(t)[F(l) + C(b)] | 160 | 111 | 69.4 | −56 | 78 | 0.70 | Invention |
| 14 | G | 90 | 9.5 | 0 | 0.5 | M(t)[F(l) + C(l)] | 152 | 126 | 82.9 | −50 | 66 | 0.52 | Comparison |
| 15 | H | 91 | 6 | 3 | 0 | M(t)[F(l) + C(b)] | 118 | 81 | 68.6 | −170 | 62 | 0.77 | Invention |
| 16 | H | 0 | 0 | 100 | 0 | M(q) | 114 | 87 | 76.3 | −60 | 56 | 0.64 | Comparison |
| 17 | H | 93 | 4 | 3 | 0 | M(t)[F(l) + C(l)] | 120 | 85 | 70.8 | −165 | 64 | 0.72 | Invention |
| 18 | I | 85 | 12(P) | 3 | 0 | F + P | 68 | 41 | 61.0 | −120 | 40 | 0.98 | Invention |
| 19 | I | 85 | 15(P) | 0 | 0 | " | 60 | 42 | 70.0 | −106 | 39 | 0.93 | Comparison |

(Note) F: ferrite, F(l): lath ferrite, C: cementite, c(b): inter-lath cementite layer, C(l): in-lath cementite, P: pearlite, C(g): in-grain cementite, M(q): as-quenched martensite, M(t): tempered martensite, B: bainite, A(r): retained austenite, TS: tensile strength, YS: yield strength, YR: yield ratio, FATT: fracture appearance transition temperature, FL: fatigue limit,

TABLE 29

| No. | Steel | Phase proportion (%) F | C | M(q) | A(r) | Condition of coexisting ferrite and cementite | Mechanical properties TS (kgf/mm²) | YS (kgf/mm²) | YR (%) | FATT (°C.) | FL (kgf/mm²) | FL/YS | Remarks |
|---|---|---|---|---|---|---|---|---|---|---|---|---|---|
| 20 | J | 87 | 9(P) | 4 | 0 | F + P | 70 | 42 | 60.0 | −75 | 41 | 0.98 | Invention |
| 21 | J | 88 | 11.8(P) | 0.2 | 0 | " | 63 | 45 | 71.4 | −62 | 40 | 0.89 | Comparison |
| 22 | K | 76 | 22(p) | 2 | 0 | " | 66 | 40 | 60.6 | −73 | 39 | 0.98 | Invention |
| 23 | K | 74 | 26(p) | 0 | 0 | " | 59 | 42 | 71.0 | −62 | 38 | 0.90 | Comparison |
| 24 | L | 92 | 7.5 | 0.5 | 0 | M(t)[F(l) + C(l)] | 67 | 54 | 80.5 | −100 | 51 | 0.94 | Invention |
| 25 | L | 92 | 8 | 0 | 0 | M(t)[F(l) + C(l)] | 57 | 53 | 92.9 | −90 | 44 | 0.83 | Comparison |

(Note) F: ferrite, F(l): lath ferrite, C: cementite, C(b): inter-lath cementite layer, C(l): in-lath cementite, P: pearlite, M(q): as-quenched martensite, M(t): tempered martensite, B: bainite, A(r): retained austenite, TS: tensile strength, YS: yield strength, YR: yield ratio, FATT: fracture appearance transition temperature, FL: fatigue limit,

TABLE 30

| No. | Steel | Phase proportion (%) F | C | M(q) | A(r) | Condition of coexisting ferrite and cementite | Mechanical properties TS (kgf/mm²) | YS (kgf/mm²) | YR (%) | FATT (°C.) | FL (kgf/mm²) | FL/YS | Remarks |
|---|---|---|---|---|---|---|---|---|---|---|---|---|---|
| 26 | M | 91 | 5 | 3.8 | 0 | M(t)[F(l) + C(b)] | 76 | 57 | 75.0 | −88 | 51 | 0.89 | Invention |
| 27 | M | 90 | 10 | 0 | 0 | M(t)[F(l) + C(l)] | 60 | 54 | 90.0 | −91 | 44 | 0.80 | Comparison |

(Note) F: ferrite, F(l): lath ferrite, C: cementite, C(b): inter-lath cementite layer, C(l): in-lath cementite, P: pearlite, M(q): as-quenched martensite, M(t): tempered martensite, B: bainite, A(r): retained austenite, TS: tensile strength, YS: yield strength, YR: yield ratio, FATT: fracture appearance transition temperature, FL: fatigue limit,

TABLE 32

| No. | Steel | Phase proportion (%) F | C | M(q) | A(r) | Condition of coexisting ferrite and cementite | Mechanical properties TS (kgf/mm²) | YS (kgf/mm²) | YR (%) | FATT (°C.) | FL (kgf/mm²) | FL/YS | Remarks |
|---|---|---|---|---|---|---|---|---|---|---|---|---|---|
| 1 | A | 75 | 18.9(B) | 0 | 6.1 | F + B | 56 | 34.7 | 62.0 | −100 | 34.7 | 1.00 | Invention |
| 2 | A | 76 | 24(B) | 0 | 0 | " | 55 | 40 | 72.7 | −93 | 37 | 0.93 | Comparison |
| 3 | B | 62 | 36(P + B) | 0 | 2.0 | F + P + B | 57 | 37.5 | 65.9 | −103 | 36.5 | 0.97 | Invention |
| 4 | B | 65 | 35(P + B) | 0 | 0 | " | 58 | 44 | 75.9 | −92 | 38 | 0.86 | Comparison |
| 5 | C | 90 | 8(P) | 0 | 2 | F + P | 66 | 41 | 62.1 | −115 | 40 | 0.98 | Invention |
| 6 | C | 89 | 11 | 0 | 0 | " | 67 | 49 | 73.1 | −86 | 43 | 0.88 | Comparison |

(Note) F: ferrite, F(l): lath ferrite, C: cementite, C(b): inter-lath cementite layer, C(l): in-lath cementite, P: pearlite, M(q): as-quenched martensite, M(t): tempered martensite, B: bainite, A(r): retained austenite, TS: tensile strength, YS: yield strength, YR: yield ratio, FATT: fracture appearance transition temperature, FL: fatigue limit,

TABLE 33

| No. | Steel | Phase proportion (%) F | C | M(q) | A(r) | Condition of coexisting ferrite and cementite | Mechanical properties TS (kgf/mm²) | YS (kgf/mm²) | YR (%) | FATT (°C.) | FL (kgf/mm²) | FL/YS | Remarks |
|---|---|---|---|---|---|---|---|---|---|---|---|---|---|
| 7 | D | 91 | 6.8(p) | 0 | 2.2 | F + B | 57.5 | 36.9 | 64.2 | −70 | 36 | 0.98 | Invention |
| 8 | D | 90 | 9.5(p) | 0 | 0.5 | " | 57.6 | 42.2 | 73.3 | −56 | 39 | 0.92 | Comparison |
| 9 | E | 61 | 27(P) | 0 | 12 | F + P | 45.6 | 27.3 | 59.9 | −25 | 27 | 0.99 | Invention |
| 10 | E | 62 | 38(p) | 0 | 0 | " | 47.1 | 33.6 | 71.3 | +10 | 30 | 0.89 | Comparison |
| 11 | F | 88 | 8 | 0 | 4 | M(t)[F(l) + C(b)] | 94.2 | 66.1 | 70.2 | −120 | 59 | 0.89 | Invention |
| 12 | F | 89 | 10.8 | 0 | 0.2 | M(t)[F(l) + C(l)] | 93.6 | 84.2 | 90.0 | −105 | 58 | 0.69 | Comparison |

(Note) F: ferrite, F(i): lath ferrite, C: cementite, C(b): inter-lath cementite layer, C(l): in-lath cementite, P: pearlite, M(q): as-quenched martensite, M(t): tempered martensite, B: bainite, A(r): retained austenite, TS: tensile strength, YS: yield strength, YR: yield ratio, FATT: fracture appearance transition temperature, FL: fatigue limit,

TABLE 34

| No. | Steel | Phase proportion (%) F | C | M(q) | A(r) | Condition of coexisting ferrite and cementite | Mechanical properties TS (kgf/mm²) | YS (kgf/mm²) | YR (%) | FATT (°C.) | FL (kgf/mm²) | FL/YS | Remarks |
|---|---|---|---|---|---|---|---|---|---|---|---|---|---|
| 13 | G | 86 | 8.7 | 0 | 5.3 | M(t)[F(l) + C(b)] | 155 | 105.9 | 68.3 | −60 | 72 | 0.68 | Invention |
| 14 | G | 63 | 0 | 0 | 31 | M(t) | *111/161 | *74.5/108 | *67.1/67.1 | −25 | 55 | 0.56/0.74 | Comparison |
| 15 | H | 87 | 12.2 | 0 | 0.8 | M(t)[F(l) + C(l)] | 80.5 | 75.7 | 94.0 | −160 | 55 | 0.73 | Comparison |
| 16 | H | 0 | 0 | 100 | 0 | M(q) | 114 | 87.4 | 76.7 | −60 | 56 | 0.64 | Comparison |
| 17 | H | 81 | 15 | 0 | 4 | M(t)[F(l) + C(b)] | 93 | 65 | 69.9 | −170 | 58 | 0.89 | Invention |
| 18 | I | 85 | 11(P) | 0 | 4 | F + P | 68 | 41 | 60 | −110 | 40 | 0.98 | Invention |
| 19 | I | 85 | 15(P) | 0 | 0 | " | 63 | 44 | 70 | −92 | 39 | 0.89 | Comparison |

(Note) F: ferrite, F(l): lath ferrite, C: cementite, C(b): inter-lath cementite layer, C(l): in-lath cementite, P: pearlite, M(q): as-quenched martensite, M(t): tempered martensite, B: bainite, A(r): retained austenite, TS: tensile strength, YS: yield strength, YR: yield ratio, FATT: fracture appearance transition temperature, FL: fatigue limit,

TABLE 35

Condition of Mechanical properties

| No. | Steel | Phase proportion (%) F | C | M(q) | A(r) | coexisting ferrite and cementite | TS (kgf/mm²) | YS (kgf/mm²) | YR (%) | FATT (°C.) | FL (kgf/mm²) | FL/YS | Remarks |
|---|---|---|---|---|---|---|---|---|---|---|---|---|---|
| 20 | J | 88 | 9(P) | 0 | 3 | F + B | 63 | 41 | 65 | −81 | 41 | 1.00 | Invention |
| 21 | J | 88 | 12(p) | 0 | 0 | " | 64 | 46 | 72 | −64 | 40 | 0.87 | Comparison |
| 22 | K | 72 | 22(p) | 0 | 6 | " | 60 | 39 | 65 | −73 | 38 | 0.97 | Invention |
| 23 | K | 73 | 27(p) | 0 | 0 | " | 57 | 42 | 74 | −61 | 38 | 0.90 | Comparison |
| 24 | L | 91 | 5 | 0 | 4 | M(t)[F(l) + C(b)] | 65 | 50 | 77 | −110 | 49 | 0.98 | Invention |
| 25 | L | 90 | 10 | 0 | 0 | M(t)[F(l) + C(l)] | 54 | 52 | 96 | −92 | 44 | 0.85 | Comparison |

(Note) F: ferrite, F(l): lath ferrite, C: cementite, C(b): inter-lath cementite layer, C(l): in-lath cementite, P: pearlite, M(q): as-quenched martensite, M(t): tempered martensite, B: bainite, A(r): retained austenite, TS: tensile strength, YS: yield strength, YR: yield ratio, FATT: fracture appearance transition temperature, FL: fatigue limit,

TABLE 36

| No. | Steel | Phase proportion (%) F | C | M(q) | A(r) | Condition of coexisting ferrite and cementite | Mechanical properties TS (kgf/mm²) | YS (kgf/mm²) | YR (%) | FATT (°C.) | FL (kgf/mm²) | FL/YS | Remarks |
|---|---|---|---|---|---|---|---|---|---|---|---|---|---|
| 26 | M | 89 | 6 | 0 | 5 | M(t)[F(l) + C(b)] | 73 | 51 | 70 | −100 | 49 | 0.96 | Invention |
| 27 | M | 90 | 9.5 | 0 | 0.5 | M(t)[F(l) + C(l)] | 59 | 52 | 88 | -89 | 43 | 0.83 | Comparison |

(Note) F: ferrite, F(l): lath ferrite, C: cementite, C(b): inter-lath cementite layer, C(l): in-lath cementite, P: pearlite, M(q): as-quenched martensite, M(t): tempered martensite, B: bainite, A(r): retained austenite, TS: tensile strength, YS: yield strength, YR: yield ratio, FATT: fracture appearance transition temperature, FL: fatigue limit,

We claim:

1. A process of producing a steel plate having a high toughness, low yield ratio and high fatigue strength, said process comprising the steps of:

hot-rolling a steel to form a steel plate, said steel consisting of:

0.02 to 0.5 wt % C,
0.02 to 10.0 wt % Mn,
0.01 to 1.0 wt % Si,
0.1 wt % or less Al, and
the balance consisting of Fe and unavoidable impurities;

quench-hardening the steel plate, either immediately or after reheating, after completion of the hot rolling so as to establish a quenched microstructure substantially composed of martensite, bainite or mixture thereof; and tempering the quench-hardened steel plate by heating at a heating rate of 1° C./sec or more to a temperature of high than $A_{C1}$ and holding at this temperature for a time of not more than 15 min.

2. A process of producing a steel plate having a high toughness, low yield ratio and high fatigue strength, said process comprising the steps of:

hot-rolling a steel to form a steel plate, said steel consisting of:

0.02 to 0.5 wt % C,
0.02 to 10.0 wt % Mn,
0.01 to 1.0 wt % Si,
0.1 wt % or less Al,
at least one element selected from the group consisting of:
3.0 wt % or less Mo,
10.0 wt % or less Ni,
3.0 wt % or less Cr,
0.1 wt % or less V,
0.1 wt % or less Nb,
0.1 wt % or less Ti,
0.003 wt % or less B,
10.0 wt % or less Cu,
10.0 wt % or less Co, and
3.0 wt % or less W, and
the balance consisting of Fe and unavoidable impurities;

quench-hardening the steel plate, either immediately or after reheating, after completion of the hot rolling so as to establish a quenched microstructure substantially composed of martensite, bainite or mixture thereof; and tempering the quench-hardened steel plate by heating at a heating rate of 1° C./sec or more to a temperature of higher than $A_{C1}$ and holding at this temperature for a time of not more than 15 min.

3. A process of producing a steel plate having a high toughness, low yield ratio and high fatigue strength, said process comprising the steps of:

hot-rolling a steel to form a steel plate, said steel consisting of:

0.02 to 0.5 wt % C,
0.02 to 10.0 wt % Mn,
0.01 to 1.0 wt % Si,
0.1 wt % or less Al,
at least one element selected from the group consisting of:
10.0 wt % or less Ni,
10.0 wt % or less Cu, and
10.0 wt % or less Co, and
the balance consisting of Fe and unavoidable impurities, with the following formula satisfied:

$$2Mn+.5Ni+.5\ Cu+.5Co \geqq 4\ wt\ \%;$$

quench-hardening the steel plate either immediately, or after reheating, after completion of the hot rolling so as to establish a quenched microstructure substantially composed of martensite, bainite or mixture thereof; and tempering the quench-hardened steel plate by heating to a temperature of from higher than $A_{C1}$ to the $A_{C1}$+80° C. and holding at this temperature for a time of not more than 30 min.

4. A process according to claim 3, wherein said heating to said temperature for said tempering is carried out at a heating rate of less than 1.0° C./sec.

5. A process according to claim 3, wherein said heating to said temperature for said tempering is carried out at a heating rate of 1.0° C./sec or more and said holding at said temperature is effected for a time of 15 min or more.

6. A process according to claim 3, wherein said heating to said temperature for said tempering is carried out at a heating rate of 1.0° C./sec or more and said holding at said temperature is effected for a time of less than 15 min.

7. A process of producing a steel plate having a high toughness, low yield ratio and high fatigue strength, said process comprising the steps of:

hot-rolling a steel to form a steel plate, said steel consisting of:
0.02 to 0.5 wt % C,
0.02 to 10.0 wt % Mn,
0.01 to 1.0 wt % Si,
0.1 wt % or less Al,
at least one element selected from the group consisting of:
10.0 wt % or less Ni,
10.0 wt % or less Cu, and
10.0 wt % or less Co,
at least one element selected from the group consisting of:
3.0 wt % or less Cr,
3.0 wt % or less Mo,
0.1 wt % or less V,
0.1 wt % or less Nb,
0.1 wt % or less Ti,
0.003 wt % or less B, and
3.0 wt % or less W, and
the balance consisting of Fe and unavoidable impurities, with the following formula being satisfied:

$$2Mn+.5Ni+.5\ Cu+.5Co \geqq 4\ wt\ \%;$$

quench-hardening the steel plate, either immediately or after reheating, after completion of the hot rolling so as to establish a quenched microstructure substantially composed of martensite, bainite or mixture thereof; and tempering the quench-hardened steel plate by heating to a temperature of from higher than $A_{C1}$ to the $A_{C1}$+80° C. and holding at this temperature for a time of not more than 30 min.

8. A process according to claim 7, wherein said heating to said temperature for said tempering is carried out at a heating rate of less than 1.0° C./sec.

9. A process according to claim 7, wherein said heating to said temperature for said tempering is carried out at a heating rate of 1.0° C./sec or more and said holding at said temperature is effected for a time of 15 min or more.

10. A process according to claim 7, wherein said heating to said temperature for said tempering is carried out at a heating rate of 1.0° C./sec or more and said holding at said temperature is effected for a time of less than 15 min.

11. A process of producing a steel plate having a high toughness, low yield ratio and high fatigue strength, said process comprising the steps of:

hot-rolling a steel to form a steel plate, said steel consisting of:
0.02 to 0.5 wt % C,
0.02 to 10.0 wt % Mn,
0.01 to 1.0 wt % Si,
0.1 wt % or less Al,
at least one element selected from the group consisting of:
10.0 wt % or less Ni,
10.0 wt % or less Cu, and
10.0 wt % or less Co, and
the balance consisting of Fe and unavoidable impurities, with the following formula being satisfied:

$$2Mn+.5Ni+.5\ Cu+.5Co \geqq 4\ wt\ \%;$$

quench-hardening the steel plate, either immediately or after reheating, after completion of the hot rolling so as to establish a quenched microstructure substantially composed of martensite, bainite or mixture thereof; and tempering the quench-hardened steel plate by heating at a heating rate of 0.3° C./sec or more to a temperature of higher than $A_{C1}$ and not higher than $A_{C1}$+20° C. and holding at this temperature for a time of not more than 30 min.

12. A process of producing a steel plate having a high toughness, low yield ratio and high fatigue strength, said process comprising the steps of:

hot-rolling a steel to form a steel plate, said steel consisting of:
0.02 to 0.5 wt % C,
0.02 to 10.0 wt % Mn,
0.01 to 1.0 wt % Si,
0.1 wt % or less Al,
at least one element selected from the group consisting of:
10.0 wt % or less Ni,
10.0 wt % or less Cu, and
10.0 wt % or less Co,
at least one element selected from the group consisting of:
3.0 wt % or less Cr,
3.0 wt % or less Mo,
0.1 wt % or less V,
0.1 wt % or less Nb,
0.1 wt % or less Ti,
0.003 wt % or less B, and
3.0 wt % or less W, and
the balance consisting of Fe and unavoidable impurities, with the following formula satisfied:

$$2Mn+.5Ni+.5\ Cu+.5Co \geqq 4\ wt\ \%;$$

quench-hardening the steel plate either immediately, or after reheating, after completion of the hot rolling so as to establish a quenched microstructure substantially composed of martensite, bainite or mixture thereof; and tempering the quench-hardened steel plate by heating at a heating rate of 0.3° C./sec or more to a temperature of higher than $A_{C1}$ and not higher than $A_{C1}$+20° C. and holding at this temperature for a time of not more than 30 min.

13. A steel plate having a high toughness, low yield strength and high fatigue strength, said steel consisting of:

0.02 to 0.35 wt % C;

0.02 to 2.5 wt % Si;

0.30 to 3.5 wt % Mn;

0.002 to 0.10 wt % Al; and the balance consisting of Fe and unavoidable impurities: said steel having a metallographical microstructure substantially composed of ferrite, cementite, and 0.5 to 5% by area of martensite.

14. A steel plate according to claim 13, wherein said ferrite is a lath ferrite.

15. A steel plate according to claim 13, wherein said cementite is present in the form of a layer between said ferrite laths and in an amount of from 1 to 40% by area.

16. A steel plate having a high toughness, low yield strength and high fatigue strength, said steel consisting of:

0.02 to 0.35 wt % C;

0.02 to 2.5 wt % Si;

0.30 to 3.5 wt % Mn;

0.002 to 0.10 wt % Al;

at least one component selected from the group consisting of the components (a), (b), (c), (d), and (e) which are defined as;

(a) at least one component for grain refining and precipitation hardening selected from the subgroup consisting of, 0.002 to 0.10 wt % Nb, and 0.002 to 0.10 wt % Ti, (b) at least one component for improving quench-hardenability selected from the subgroup consisting of, 0.05 to 3.0 wt % Cu, 0.05 to 10.0 wt % Ni, 0.05 to 10.0 wt % Cr, 0.05 to 3.5 wt % Mo, 0.05 to 10.0 wt % Co, and 0.05 to 2.0 wt % W, (c) 0.002 to 0.10 wt % V as a component for precipitation hardening, (d) 0.003 to 0.0025 wt % B as a component for improving quench-hardenability, and (e) at least one component for making sulphur harmless selected from the subgroup consisting of, 0.002 to 0.10 wt % REM, and 0.0003 to 0.0030 wt % Ca the balance consisting of Fe and unavoidable impurities: said steel having a metallographical microstructure substantially composed of ferrite, cementite, and 0.5 to 5% by area of martensite.

17. A steel plate according to claim 16, wherein said ferrite is a lath ferrite.

18. A steel plate according to claim 16, wherein said cementite is present in the form of a layer between said ferrite laths, in an amount of from 1 to 40% by area.

19. A steel plate having a high toughness, low yield strength and high fatigue strength, said steel consisting of:

0.02 to 0.35 wt % C;

0.02 to 2.5 wt % Si;

0.30 to 3.5 wt % Mn;

0.002 to 0.10 wt % Al; and the balance consisting of Fe and unavoidable impurities: said steel having a metallographical microstructure substantially composed of ferrite, cementite, and 1 to 30% by volume of retained austenite.

20. A steel plate according to claim 19, wherein said ferrite is a lath ferrite.

21. A steel plate according to claim 19, wherein said cementite is present in the form of a layer between said ferrite laths, in an amount of from 1 to 40% by area.

22. A steel plate having a high toughness, low yield strength and high fatigue strength, said steel consisting of:

0.02 to 0.35 wt % C;

0.02 to 2.5 wt % Si;

0.30 to 3.5 wt % Mn;

0.002 to 0.10 wt % Al;

at least one component selected from the group consisting of the components (a), (b), (c), (d), and (e) which are defined as;

(a) at least one component for grain refining and precipitation hardening selected from the subgroup consisting of, 0.002 to 0.10 wt % Nb, and 0.002 to 0.10 wt % Ti, (b) at least one component for improving quench-hardenability selected from the subgroup consisting of, 0.05 to 3.0 wt % Cu, 0.05 to 10.0 wt % Ni, 0.05 to 10.0 wt % Cr, 0.05 to 3.5 wt % Mo, 0.05 to 10.0 wt % Co, and 0.05 to 2.0 wt % W, (c) 0.002 to 0.10 wt % V as a component for precipitation hardening, (d) 0.003 to 0.0025 wt % B as a component for improving quench-hardenability, and (e) at least one component for making sulphur harmless selected from the subgroup consisting of, 0.002 to 0.10 wt % REM, and 0.0003 to 0.0030 wt % Ca the balance consisting of Fe and unavoidable impurities: said steel having a metallographical microstructure substantially composed of ferrite, cementite, and 0.5 to 5% by area of martensite.

23. A steel plate according to claim 16, wherein said ferrite is a lath ferrite.

24. A steel plate according to claim 16, wherein said cementite is present in the form of a layer between said ferrite laths, in an amount of from 1 to 40% by area.

25. A process of producing a steel plate having a high toughness, low yield ratio and high fatigue strength, said process comprising the steps of:

preparing a hot-rolled steel plate consisting of:

0.02 to 0.35 wt % C;

0.02 to 2.5 wt % Si;

0.30 to 3.5 wt % Mn;

0.002 to 0.10 wt % Al; and the balance consisting of Fe and unavoidable impurities, said steel plate having a metallographical microstructure substantially composed of ferrite and cementite;

heating said steel plate sufficiently rapidly to prevent coarsening of said microstructure, to a temperature of $A_{C1}$ or higher but sufficiently low to ensure an austenite amount of not more than 30% by volume;

holding said steel plate at said temperature so that cementite present before, or generated during, said heating is partially transformed into austenite; and then cooling said steel plate to room temperature at a cooling rate which ensures establishment of a metallographical microstructure substantially composed of ferrite, cementite, and 0.5 to 5% by area of martensite.

26. A process of producing a steel plate having a high toughness, low yield ratio and high fatigue strength, said process comprising the steps of:

preparing a hot-rolled steel plate consisting of:

0.02 to 0.35 wt % C;

0.02 to 2.5 wt % Si;

0.30 to 3.5 wt % Mn;

0.002 to 0.10 wt % Al;

at least one component selected from the group consisting of the components (a), (b), (c), (d), and (e) which are defined as;

(a) at least one component for grain refining and precipitation hardening selected from the subgroup consisting of, 0.002 to 0.10 wt % Nb, and 0.002 to 0.10 wt % Ti, (b) at least one component for improving quench-hardenability selected from the subgroup consisting of, 0.05 to 3.0 wt % Cu, 0.05 to 10.0 wt % Ni, 0.05 to 10.0 wt % Cr, 0.05 to 3.5 wt % Mo, 0.05 to 10.0 wt % Co, and 0.05 to 2.0 wt % W, (c) 0.002 to 0.10 wt % V as a component for precipitation hardening, (d) 0.003 to 0.0025 wt % B as a component for improving quench-hardenability, and (e) at least one component for making sulphur harmless selected from the subgroup consisting of, 0.002 to 0.10 wt % REM, and 0.0003 to 0.0030 wt % Ca; and the balance consisting of Fe and unavoidable impurities: said steel having a metallographical microstructure substantially composed of ferrite and cementite;

heating said steel plate sufficiently rapidly to prevent coarsening of said microstructure, to a temperature of $A_{C1}$ or higher but sufficiently low to ensure an austenite amount of not more than 30% by volume;

holding said steel plate at said temperature so that cementite present before, or generated during, said heating is partially transformed into austenite; and then cooling said steel plate to room temperature at a cooling rate which ensures establishment of a metallographical microstructure substantially composed of ferrite, cementite, and 0.5 to 5% by area of martensite.

27. A process of producing a steel plate having a high toughness, low yield ratio and high fatigue strength, said process comprising the steps of:

preparing a hot-rolled steel plate consisting of:

0.02 to 0.35 wt % C;

0.02 to 2.5 wt % Si;

0.30 to 3.5 wt % Mn;

0.002 to 0.10 wt % Al; and the balance consisting of Fe and unavoidable impurities, said steel plate having a metallographical microstructure substantially composed of lath-form crystals, such as as-quenched bainite or martensite, that contain dissolved carbon and iron carbides;

heating said steel plate sufficiently rapidly to prevent coarsening of said microstructure, to a temperature of not lower than $A_{C1}$ but sufficiently low to ensure an austenite amount of not more than 30% by volume;

holding said steel plate at said temperature so that cementite present before, or generated during, said heating is partially transformed into austenite; and then cooling said steel plate to room temperature at a cooling rate which ensures establishment of a metallographical microstructure substantially composed of ferrite, cementite, and 0.5 to 5% by area of martensite.

28. A process of producing a steel plate having a high toughness, low yield ratio and high fatigue strength, said process comprising the steps of:

preparing a hot-rolled steel plate consisting of:

0.02 to 0.35 wt % C;

0.02 to 2.5 wt % Si;

0.30 to 3.5 wt % Mn;

0.002 to 0.10 wt % Al;

at least one component selected from the group consisting of the components (a), (b), (c), (d), and (e) which are defined as;

(a) at least one component for grain refining and precipitation hardening selected from the subgroup consisting of, 0.002 to 0.10 wt % Nb, and 0.002 to 0.10 wt % Ti, (b) at least one component for improving quench-hardenability selected from the subgroup consisting of, 0.05 to 3.0 wt % Cu, 0.05 to 10.0 wt % Ni, 0.05 to 10.0 wt % Cr, 0.05 to 3.5 wt % Mo, 0.05 to 10.0 wt % Co, and 0.05 to 2.0 wt % W, (c) 0.002 to 0.10 wt % V as a component for precipitation hardening, (d) 0.003 to 0.0025 wt % B as a component for improving quench-hardenability, and (e) at least one component for making sulphur harmless selected from the subgroup consisting of, 0.002 to 0.10 wt % REM, and 0.0003 to 0.0030 wt % Ca; and the balance consisting of Fe and unavoidable impurities, said steel plate having a metallographical microstructure substantially composed of lath-form crystals, such as as-quenched bainite or martensite, that contain dissolved carbon and iron carbides;

heating said steel plate sufficiently rapidly to prevent coarsening of said microstructure, to a temperature of $A_{C1}$ or higher but sufficiently low to ensure an austenite amount of not more than 30% by volume;

holding said steel plate at said temperature so that cementite present before, or generated during, said heating is partially transformed into austenite; and then cooling said steel plate to room temperature at a cooling rate which ensures establishment of a metallographical microstructure substantially composed of ferrite, cementite, and 0.5 to 5% by area of martensite.

29. A process of producing a steel plate having a high toughness, low yield ratio and high fatigue strength, said process comprising the steps of:

preparing a hot-rolled steel plate consisting of:

0.02 to 0.35 wt % C;

0.02 to 2.5 wt % Si;

0.30 to 3.5 wt % Mn;

0.002 to 0.10 wt % Al; and the balance consisting of Fe and unavoidable impurities, said steel plate having a metallographical microstructure substantially composed of ferrite and cementite;

heating said steel plate sufficiently rapidly to prevent coarsening of said microstructure, to a temperature of not lower than $A_{C1}$ but sufficiently low to ensure an austenite amount of not more than 30% by volume;

holding said steel plate at said temperature so that cementite present before, or generated during, said heating is partially transformed into austenite; and then cooling said steel plate to room temperature at a cooling rate which ensures establishment of a metallographical microstructure substantially composed of ferrite, cementite, and 1 to 30% by volume of austenite.

30. A process of producing a steel plate having a high toughness, low yield ratio and high fatigue strength, said process comprising the steps of:

preparing a hot-rolled steel plate consisting of:

0.02 to 0.35 wt % C;

0.02 to 2.5 wt % Si;

0.30 to 3.5 wt % Mn;

0.002 to 0.10 wt % Al;

at least one component selected from the group consisting of the components (a), (b), (c), (d), and (e) which are defined as;

(a) at least one component for grain refining and precipitation hardening selected from the subgroup consisting of, 0.002 to 0.10 wt % Nb, and 0.002 to 0.10 wt % Ti, (b) at least one component for improving quench-hardenability selected from the subgroup consisting of, 0.05 to 3.0 wt % Cu, 0.05 to 10.0 wt % Ni, 0.05 to 10.0 wt % Cr, 0.05 to 3.5 wt % Mo, 0.05 to 10.0 wt % Co, and 0.05 to 2.0 wt % W, (c) 0.002 to 0.10 wt % V as a component for precipitation hardening, (d) 0.003 to 0.0025 wt % B as a component for improving quench-hardenability, and (e) at least one component for making sulphur harmless selected from the subgroup consisting of, 0.002 to 0.10 wt % REM, and 0.0003 to 0.0030 wt % Ca; and the balance consisting of Fe and unavoidable impurities, said steel plate having a metallographical microstructure substantially composed of ferrite and cementite;

heating said steel plate sufficiently rapidly to prevent coarsening of said microstructure, to a temperature of not lower than $A_{C1}$ but sufficiently low to ensure an austenite amount of not more than 30% by volume;

holding said steel plate at said temperature so that cementite present before, or generated during, said heating is partially transformed into austenite; and then cooling said steel plate to room temperature at a cooling rate which ensures establishment of a metallographical microstructure substantially composed of ferrite, cementite, and 1 to 30% by volume of austenite.

31. A process of producing a steel plate having a high toughness, low yield ratio and high fatigue strength, said process comprising the steps of:

preparing a hot-rolled steel plate consisting of:

0.02 to 0.35 wt % C;

0.02 to 2.5 wt % Si;

0.30 to 3.5 wt % Mn;

0.002 to 0.10 wt % Al; and the balance consisting of Fe and unavoidable impurities, said steel plate having a metallographical microstructure substantially composed of lath-form crystals, such as as-quenched bainite or martensite, that contain dissolved carbon and iron carbides;

heating said steel plate sufficiently rapidly to prevent coarsening of said microstructure, to a temperature of $A_{C1}$ or higher but sufficiently low to ensure an austenite amount of not more than 30% by volume;

holding said steel plate at said temperature so that cementite present before, or generated during, said heating is partially transformed into austenite; and then cooling said steel plate to room temperature at a cooling rate which ensures establishment of a metallographical microstructure substantially composed of ferrite, cementite, and 1 to 30% by volume of austenite.

32. A process of producing a steel plate having a high toughness, low yield ratio and high fatigue strength, said process comprising the steps of:

preparing a hot-rolled steel plate consisting of:

0.02 to 0.35 wt % C;

0.02 to 2.5 wt % Si;

0.30 to 3.5 wt % Mn;

0.002 to 0.10 wt % Al;

at least one component selected from the group consisting of the components (a), (b), (c), (d), and (e) which are defined as;

(a) at least one component for grain refining and precipitation hardening selected from the subgroup consisting of, 0.002 to 0.10 wt % Nb, and 0.002 to 0.10 wt % Ti, (b) at least one component for improving quench-hardenability selected from the subgroup consisting of, 0.05 to 3.0 wt % CU, 0.05 to 10.0 wt % Ni, 0.05 to 10.0 wt % Cr, 0.05 to 3.5 wt % Mo, 0.05 to 10.0 wt % Co, and 0.05 to 2.0 wt % W, (c) 0.002 to 0.10 wt % V as a component for precipitation hardening, (d) 0.003 to 0.0025 wt % B as a component for improving quench-hardenability, and (e) at least one component for making sulphur harmless selected from the subgroup consisting of, 0.002 to 0.10 wt % REM, and 0.0003 to 0.0030 wt % Ca; and the balance consisting of Fe and unavoidable impurities, said steel plate having a metallographical microstructure substantially composed of lath-form crystals, such as as-quenched bainite or martensite, that contain dissolved carbon and iron carbides;

heating said steel plate sufficiently rapidly to prevent coarsening of said microstructure, to a temperature of $A_{C1}$ or higher but sufficiently low to ensure an austenite amount of not more than 30% by volume;

holding said steel plate at said temperature so that cementite present before, or generated during, said heating is partially transformed into austenite; and then cooling said steel plate to room temperature at a cooling rate which ensures establishment of a metallographical microstructure substantially composed of ferrite, cementite, and 1 to 30% by volume of austenite.

* * * * *

UNITED STATES PATENT AND TRADEMARK OFFICE

CERTIFICATE OF CORRECTION

PATENT NO. : 5,454,883

DATED : October 3, 1995

INVENTOR(S) : A. YOSHIE et al.

It is certified that error appears in the above-indentified patent and that said Letters Patent is hereby corrected as shown below:

At Col. 3, line 41; Col. 4, line 14; Col. 4, line 46; Col. 5, line 17; Col. 38, line 58; Col. 39, line 38; Col. 40, line 8; and Col. 40, line 46; delete ".5Ni+.5Cu+.5Co" and insert --2.5Ni+1.5Cu+0.5Co--.

Signed and Sealed this

Tenth Day of September, 1996

Bruce Lehman

*Attest:*

BRUCE LEHMAN

*Attesting Officer*

*Commissioner of Patents and Trademarks*